US006921217B2

(12) United States Patent
Tsuji

(10) Patent No.: US 6,921,217 B2
(45) Date of Patent: Jul. 26, 2005

(54) GAP ADJUSTING DEVICE, RECORDING APPARATUS AND LIQUID EJECTION APPARATUS

(75) Inventor: Keishiro Tsuji, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/840,678

(22) Filed: May 7, 2004

(65) Prior Publication Data

US 2005/0002714 A1 Jan. 6, 2005

(30) Foreign Application Priority Data

| | | |
|---|---|---|
| May 8, 2003 | (JP) | 2003-130204 |
| May 8, 2003 | (JP) | 2003-130221 |
| Aug. 28, 2003 | (JP) | 2003-305372 |
| Sep. 24, 2003 | (JP) | 2003-332085 |
| Sep. 24, 2003 | (JP) | 2003-332154 |

(51) Int. Cl.[7] ..... B41J 11/20; B41J 25/308

(52) U.S. Cl. ..... 400/59; 400/55; 400/56; 400/355; 400/354; 347/8

(58) Field of Search ..... 400/55, 56, 59, 400/354, 355; 347/8; B41J 25/308

(56) References Cited

U.S. PATENT DOCUMENTS

| | | | | |
|---|---|---|---|---|
| 5,692,842 A | | 12/1997 | Sasai et al. | |
| 5,815,171 A | * | 9/1998 | Brugue | 347/8 |
| 6,027,264 A | * | 2/2000 | Maher et al. | 400/55 |
| 6,616,355 B2 | * | 9/2003 | Cleary et al. | 400/56 |
| 6,736,557 B2 | * | 5/2004 | DeVore et al. | 400/59 |
| 2002/0098025 A1 | * | 7/2002 | Lee et al. | 400/55 |

FOREIGN PATENT DOCUMENTS

| | | |
|---|---|---|
| EP | 0 856 412 B1 | 4/2001 |
| JP | 8-300769 A | 11/1996 |
| JP | 10-211748 A | 8/1998 |
| JP | 2002-36660 A | 2/2002 |
| JP | 2002-251791 A | 9/2002 |

* cited by examiner

*Primary Examiner*—Ren Yan
*Assistant Examiner*—Marissa Ferguson
(74) *Attorney, Agent, or Firm*—Sughrue Mion, PLLC

(57) ABSTRACT

The present invention provides a gap adjusting device that allows gap adjustment with a small torque and also allows more gap positions to be set. The gap adjusting device rotates bushing members so as to change level (PG) of carriage guide shafts for guiding a carriage. An intermediate gear that engages with the bushing members has a boss to be inserted into a cam groove formed in a slidable member that can slide. In accordance with a sliding operation of the slidable member 51, PG is changed. The weights of the carriage and the carriage guide shafts are transmitted to the boss via the bushing members and the intermediate gear and therefore the boss is pushed against a sidewall of the cam groove to be in contact with the sidewall, thereby PG is maintained. Therefore, the slidable member 51 can be caused to slide with a small torque.

21 Claims, 26 Drawing Sheets

GAP ADJUSTING DEVICE, RECORDING APPARATUS AND LIQUID EJECTION APPARATUS

This patent application claims priority from Japanese patent applications Nos. 2003-130204 filed on May 8, 2003, 2003-130221 filed on May 8, 2003, 2003-305372 filed on Aug. 28, 2003, 2003-332085 filed on Sep. 24, 2003 and 2003-332154 filed on Sep. 24, 2003, the contents of which are incorporated herein by reference.

BACKGROUND OF THE INVENTION

1. Field of the Invention

The present invention relates to a gap adjusting device for adjusting a gap defined between a recording head and a recording medium on which recording is to be performed, and a recording apparatus including such gap adjusting device. The present invention also relates to a liquid ejection apparatus.

The liquid ejection apparatus in the present application includes but not limited to a recording apparatus which uses an ink-jet type recording head and achieves printing on the recording medium by ejecting ink from the recording head, such as a printer, a copier and a facsimile machine, as well as an apparatus which uses a liquid ejection head corresponding to the ink-jet type recording head and ejects liquid suitable for an application of the apparatus in place of the ink from the ink ejection head to a medium, thereby causing the liquid to adhere to the medium.

Examples of such a liquid ejection head include a color-material ejection head used in fabrication of color filters for a liquid crystal display or the like, an electrode-material (conductive paste) ejection head used in formation of electrodes for an organic EL display or a field emission display (FED), a biological organic material ejection head used in fabrication of bio-chips, and a sample ejection head as a precise pipette, other than the aforementioned recording head.

2. Description of the Related Art

As an exemplary recording apparatus, an ink-jet printer is known in which an ink-jet recording head is provided on the bottom of a carriage that reciprocates in a main scanning direction. The carriage is caused to reciprocate in the main scanning direction by a driving force of a motor, while being guided by a carriage guide shaft extending along the main scanning direction.

In order to perform printing appropriately for each of recording media that are different in thickness, the ink-jet printer includes a gap adjusting device for adjusting a gap between the ink-jet recording head and the recording medium. The gap adjusting device includes a bushing member at an end of the carriage guide shaft, which has its center of rotation at a position away from a shaft center of the carriage guide shaft. By rotating the bushing member, the level (height) of the carriage guide shaft is moved up and down. See Japanese Patent Application Laid-Open No. 8-300769. Moreover, Japanese Patent Application Laid-Open No. 10-211748 describes that a plurality of (two, for example) carriage guide shafts are provided and bushing members respectively provided at shaft ends of the carriage guide shafts are rotated in synchronization with each other, thereby moving the carriage guide shafts up and down simultaneously.

The most of the gap adjusting devices conventionally known, including the aforementioned gap adjusting devices, are arranged to have two gap adjusting positions that are switched by an adjusting lever or the like. The adjusting lever is arranged to engage with the bushing member and rotate the busing member. See Japanese Patent Application Laid-Open No. 2002-36660. Alternatively, the two gap adjusting positions are switched by using the driving force of the motor, as described in Japanese Patent Application Laid-Open No. 10-211748. In this case, each of the two gap adjusting positions is kept by a force applied by a coil spring.

More specifically, the coil spring that engages with the adjusting lever is provided in such a manner that the forcing direction is changed at an intermediate position between the first gap position and the second gap position. The coil spring applies a force to the adjusting lever so as to keep a gap to be maintained at each gap position. Assuming that a small gap is to be maintained at the first gap position and a large gap is to be maintained at the second gap position, at the second gap position, the busing member is likely to rotate toward the first gap position side because of the weights of the carriage guide shafts and the carriage. Therefore, in order to surely maintain the second gap position, the force applied by the coil spring has to be made larger.

In a case of adjusting the gap by using the driving force of the motor, however, it is necessary to rotate the bushing member against the force applied by the coil spring. For example, in a case where the driving force is obtained from a motor that drives a feed roller for feeding the recording medium to rotate, the motor has to be selected considering the force applied by the coil spring, thus increasing the cost. Especially, in the gap adjusting device disclosed in Japanese Patent Application Laid-Open NO. 10-211748, the motor has the larger load.

In addition, in the conventional gap adjusting device described above, two gap positions, i.e., the first and second gap positions, are maintained by the coil spring. Therefore, three or more gap positions could not be provided.

SUMMARY OF THE INVENTION

Therefore, it is an object of the present invention to provide a gap adjusting device, a recording apparatus and a liquid ejection apparatus which are capable of overcoming the above drawbacks accompanying the conventional art. More specifically, the present invention aims to provide a gap adjusting device which is capable of achieving gap adjustment by a smaller torque and can also allow more gap positions to be set. The above and other objects can be achieved by combinations described in the independent claims. The dependent claims define further advantageous and exemplary combinations of the present invention.

According to the first aspect of the present invention, a gap adjusting device for use in a recording apparatus is provided. The recording apparatus includes a carriage having a recording head for performing recording onto a recording medium and a carriage guide shaft for guiding the carriage in a main scanning direction, for adjusting a gap between the recording head and the recording medium by adjusting a level of the carriage guide shaft. The gap adjusting device comprises: a bushing member attached to an end of the carriage guide shaft and a side frame that is provided to stand perpendicularly to a direction of a shaft line of the carriage guide shaft to be rotatable, the bushing member being operable to support the carriage guide shaft in such a manner that a center of rotation is not coincident with a shaft center of the carriage guide shaft; and a bushing-member rotating means operable to engage with the rotating member and rotate the bushing member, the busing-member rotating means being driven by a power of a motor. The bushing-member rotating means includes: a slidable member provided to be slidable along a surface of the side frame by the power of the motor; a slidable-member locking means operable to restrain a sliding operation of the slidable member; and a bush-member rotating member having a bushing-member engagement portion that is to engage with the bushing member and a boss inserted into a cam groove formed in the slidable member in a movable manner and being provided to be rotatable, the bush-member rotating member being rotated by displacement of the boss within the cam groove in accordance with the sliding operation of the slidable member, to rotate the bushing member, wherein a bushing-member forcing means is provided in such a manner that the boss is displaced within the cam groove while being in contact with a cam surface on one side of the cam groove and is pressed against the cam surface in a direction intersecting with a sliding direction of the slidable member, by weights of the carriage and the carriage guide shaft that act on the boss via the bushing member and the bushing-member rotating member, the bushing-member forcing means forcing the bushing member in a direction in which the busing member is forced to rotate by the weights of the carriage and the carriage guide shaft.

According to the above, the gap adjusting device includes the bushing member attached to the shaft end of the carriage guide shaft, the bushing-member rotating member for rotating the bushing member and the slidable member for rotating the bushing-member rotating member. The sliding operation of the slidable member displaces the boss provided on the bushing-member rotating member within the cam groove formed in the slidable member, thereby rotating the bushing-member rotating member to change the level (height) of the carriage guide shaft. In this operation, the weights of the carriage and the carriage guide shaft act on the boss via the bushing member and the bushing-member rotating member, and the boss is displaced within the cam groove while being in contact with the cam surface on one side of the cam groove and is pushed against that cam surface in the direction intersecting with the sliding direction of the slidable member. Therefore, the weights of the carriage and the carriage guide shaft do not act directly in the sliding direction of the slidable member but act in the direction intersecting with the sliding direction, thus allowing the level of the carriage guide shaft to be changed with a smaller torque and allowing a gap position to be maintained. In other words, it is possible to adjust the gap with a smaller torque and to set a larger number of gap positions.

Moreover, the gap adjusting device includes the bushing-member forcing means for forcing the bushing member in the direction in which the bushing member is forced to rotate by the weights of the carriage and the carriage guide shaft. Therefore, the bushing member is forced in that direction by a force obtained by adding the weights of the carriage and the carriage guide shaft and the force applied by the bushing-member forcing means. As described above, the gap adjusting device is arranged in such a manner that the weights of the carriage and the carriage guide shaft act on the boss via the bushing member and the bushing-member rotating member and therefore the boss is displaced within the cam groove while being in contact with the cam surface on one side of the cam groove and is pushed against that cam surface in the direction intersecting with the sliding direction of the slidable member.

Thus, the boss of the bushing-member rotating member is pushed to slide in the direction intersecting with the sliding direction of the slidable member on the cam surface on one side of the cam groove, by the force obtained by adding the weights of the carriage and the carriage guide shaft and the force applied by the bushing-member forcing means. This can makes the displaced position of the boss inserted in the cam groove more stable. Therefore, an advantageous effect is obtained that the gap between the recording head and the recording medium, that is defined by the displaced position of the boss of the bushing-member rotating member, can be set with higher precision. This effect is larger in a recording apparatus that has an off-carriage structure (in which no ink cartridge is mounted on the carriage) and includes a light carriage.

The bushing member and the bushing-member engagement portion of the bushing-member rotating member may make gear engagement to form together an arrangement of transmitting rotation.

According to the above, the force obtained by adding the weights of the carriage and the carriage guide shaft to the force applied by the bushing-member forcing means always acts on the gear engagement portion between the bushing member and the bushing-member rotation member. Thus, backlash can be prevented between the bushing member and the bushing-member rotating member.

The cam groove may have a changing portion where the gap is changed and an unchanging portion where the gap is prevented from being changed and is formed in a stairway-like shape, to allow step wise adjustment of the gap between a plurality of gap positions.

According to the above, the gap does not change when the boss is located at the unchanging portion. Therefore, in that state, it is possible to stably maintain the gap.

The cam groove may have three unchanged portions to allow the gap to be switched among three levels.

In this case, the gap can be automatically switched with the minimum torque of the motor.

The bushing-member rotating means may include a gear arrangement provided on the side frame, the gear arrangement including a rack formed on the slidable member, a pinion engaging the rack and a gear that is rotated by the power of the motor and causing the sliding operation of the slidable member by rotation of the pinion; one gear of the gear arrangement may be provided to be slidable in its rotation axis and is arranged in such a manner that the one gear is able to disconnect transmission of the power of the motor by disengaging from the gear arrangement, and a sliding operation of the one gear may be achieved by a forcing means for forcing the one gear in a direction in which the one gear engages another gear, and the carriage that pushes an engagement pin provided on the one gear in a direction in which the one gear disengages from the gear arrangement, the engagement pin protruding through an arc-shaped hole formed in the side frame toward a main scanning region of the carriage.

According to the above, it is possible to disconnect the power transmission from the motor. Thus, as the motor, another motor (a transfer motor that drives and rotates a transfer roller for transferring the recording medium, for example) can be used.

The motor may be a transfer motor for driving and rotating a transfer roller for transferring the recording medium.

In this case, the cost can be reduced. Moreover, by the advantageous effects mentioned above, the gap adjustment can be achieved by a smaller torque.

The slidable-member locking means may include an engagement protrusion formed on a disc surface of the one gear, and a plurality of fitting holes, formed in the side frame, into which the engagement protrusion is able to fit, the fitting holes being located at positions where the engagement protrusion is to be located at a plurality of gap positions.

In this case, the slidable-member locking means is formed in such a manner that the engagement protrusion on the disc surface of one gear of the gear arrangement fits into the fitting hole formed in the side frame so as to stop the rotation of that gear, thereby locking the slidable member. A plurality of fitting holes are provided at positions where the engagement protrusion is to be located at a plurality of gap positions. Thus, it is possible to surely maintain the gap at each of a plurality of gap positions.

The carriage may be arranged to be guided by two carriage guide shafts arranged in a sub-scanning direction with a predetermined space, and the bushing-member rotating member is arranged between the two carriage guide shafts to rotate the bushing member attached to the shaft end of each of the two carriage guide shaft simultaneously.

In this case, it is possible to easily change the levels of the two carriage guide shafts with a simple structure in synchronization with each other.

According to the second aspect of the present invention, a recording apparatus comprises: a carriage including a recording head for performing recording onto a recording medium; a carriage guide shaft operable to guide the carriage in a main scanning direction; and a gap adjusting device operable to adjust a level of the carriage guide shaft to adjust a gap between the recording head and the recording medium, wherein the gap adjusting device is any one of the gap adjusting devices mentioned above.

Thus, the advantageous effects mentioned above can be also achieved.

According to the third aspect of the present invention, a liquid ejection apparatus comprises: a carriage having a liquid ejection head for performing liquid ejection onto a medium; a carriage guide shaft operable to guide the carriage in a main scanning direction; and a gap adjusting device operable to adjust a level of the carriage guide shaft to adjust a gap between the liquid ejection head and the medium. The gap adjusting device includes: a bushing member attached to an end of the carriage guide shaft and to a side frame that is provided to stand perpendicularly to a direction of a shaft line of the carriage guide shaft to be rotatable, the bushing member supporting the carriage guide shaft in such a manner that a center of rotation of the bushing member is not coincident with a shaft center of the carriage guide shaft; and a bushing-member rotating means operable to engage with the bushing member to rotate the bushing member, the bushing-member rotating means being driven by a power of a motor. The bushing-member rotating means includes: a slidable member provided to be slidable along a surface of the side frame by the power of the motor; a slidable-member locking means operable to restrain a sliding operation of the slidable member; and a bushing-member rotating member, provided to be rotatable and to have a bushing-member engagement portion for engaging with the bushing member and a boss to be inserted into a cam groove formed in the slidable member, the bushing-member rotating member being rotated by displacement of the boss within the cam groove in accordance with the sliding operation of the slidable member, to rotate the bushing member. Moreover, a forcing means is provided in such a manner that the boss is displaced within the cam groove while being in contact with a cam surface on one side of the cam groove is pushed toward a direction intersecting with a sliding direction of the slidable member, by weights of the carriage and the carriage guide shaft that act on the boss via the bushing member and the bushing-member rotating member, and forces the bushing member in a direction in which the bushing member is forced to rotate by the carriage and the carriage guide shaft.

According to the fourth aspect of the present invention, a gap adjusting device for use in a recording apparatus is provided. The recording apparatus includes a carriage having a recording head for performing recording onto a recording medium and a carriage guide shaft for guiding the carriage in a main scanning direction, for adjusting a level of the carriage guide shaft to adjust a gap between the recording head and the recording medium. The gap adjusting device comprises: a bushing member, attached to an end of the carriage guide shaft and to a side frame that is provided to stand perpendicularly to a direction of a shaft line of the carriage guide shaft in a rotatable manner, the bushing member supporting the carriage guide shaft in such a manner that a center of rotation of the bushing member is not coincident with a shaft center of the carriage guide shaft; and a bushing-member rotating means operable to engage with the bushing member and to rotate the bushing member, the bushing-member rotating means being driven by a power of a motor. The bushing-member rotating means includes: a slidable member provided to be slidable along a surface of the side frame by the power of the motor; a slidable member locking means operable to restrain a sliding operation of the slidable member; and a bushing-member rotating member, provided to be rotatable and to have a bushing-member engagement portion for engaging with the bushing member and a boss to be inserted into a cam groove formed in the slidable member, the bushing-member rotating member being rotated by displacement of the boss within the cam groove in accordance with the sliding operation of the slidable member, to rotate the bushing member. The boss is arranged to be displaced within the cam groove while being in contact with a cam surface on one side of the cam groove and is pushed in a direction intersecting with a sliding direction of the slidable member, by weights of the carriage and the carriage guide shaft that act on the boss via the busing member and the bushing-member rotating member.

The slidable member may include a bending restraining means operable to restrain bending of the bushing-member rotating member in a direction in which the boss inserted in the cam groove falls from the cam groove to prevent falling of the boss from the cam groove over an entire region within which the bushing-member rotating member is able to rotate.

The bending restraining means may include a guide wall formed along the cam groove, the guide groove being in contact with a portion near the boss of the bushing-member rotating member to restrain the bending of the bushing-member rotating member in the direction in which the boss falls from the cam groove in such a manner that the boss is able to be displaced within the cam groove.

The cam groove maybe formed in a stairway-like shape that has a changing portion where the gap is changed and an unchanged portion where the gap is prevented from being changed to adjust the gap between a plurality of gap positions.

The cam groove may have three unchanged portions to allow switching of the gap among three levels.

The bushing-member rotating means may include a gear arrangement provided on the side frame, the gear arrangement including a rack formed on the slidable member, a pinion engaging with the rack and a transmission gear operable to rotate by the power of the motor, the gear arrangement being arranged to slide the slidable member by rotation of the pinion. One gear of the gear arrangement may be arranged be slidable in its rotation axis to be able to disconnect transmission of the power of the motor by disengaging from the gear arrangement. A sliding operation of the one gear may be achieved by a forcing means operable to force the one gear toward a direction in which the one gear engages with another gear, and the carriage that pushes an engagement pin formed on the one gear toward a direction in which the one gear disengages from the gear arrangement, the engagement pin protruding through an arc-shaped hole formed in the side frame toward a main scanning region of the carriage.

The motor may be a transfer motor for driving and rotating a transfer roller for transferring there cording medium.

The slidable-member locking means may include an engagement protrusion formed on a disc face of the one gear, and a plurality of fitting holes formed in the side frame, into which the engagement protrusion is able to fit, the fitting holes being arranged at positions at which the engagement protrusion is to be located at a plurality of gap positions.

The carriage may be guided by two carriage guide shafts arranged in a sub-scanning direction with a predetermined space therebetween, and the bushing-member rotating member may be arranged between the two carriage guide shafts and rotates the bushing member attached to the end of each of the two carriage guide shafts simultaneously.

According to the fifth aspect of the present invention, a recording apparatus comprises: a carriage having a recording head for performing recording onto a recording medium; a carriage guide shaft operable to guide the carriage in a main scanning direction; and a gap adjusting device operable to adjust a level of the carriage guide shaft to adjust a gap between the recording head and the recording medium, wherein the gap adjusting device is any one of the gap adjusting devices mentioned above.

According to the sixth aspect of the present invention, a liquid ejection apparatus comprises: a carriage having a liquid ejection head for performing liquid ejection onto a medium; a carriage guide shaft operable to guide the carriage in a main scanning direction; and a gap adjusting device operable to adjust a level of the carriage guide shaft to adjust a gap between the liquid ejection head and the medium. The gap adjusting device includes: a bushing member, attached to an end of the carriage guide shaft and to a side frame that is provided to stand perpendicularly to a direction of a shaft line of the carriage guide shaft in a rotatable manner, the bushing member supporting the carriage guide shaft in such a manner that a center of rotation of the bushing member is not coincident with a shaft center of the carriage guide shaft; and a bushing-member rotating means operable to engage with the bushing member and to rotate the bushing member, the bushing-member rotating means being driven by a power of a motor. The bushing-member rotating means includes: a slidable member provided to be slidable along a surface of the side frame by the power of the motor; a slidable-member locking means operable to restrain a sliding operation of the slidable member; and a bushing-member rotating member provided to be rotatable and to have a bushing-member engagement portion for engaging with the bushing member and a boss to be inserted into a cam groove formed in the slidable member, the bushing-member rotating member being rotated by displacement of the boss within the cam groove in accordance with the sliding operation of the slidable member, to rotate the bushing member. The boss is arranged to be displaced within the cam groove while being in contact with a cam surface on one side of the cam groove and is pressed in a direction intersecting with a sliding direction of the slidable member, by weights of the carriage and the carriage guide shaft that act on the boss via the bushing member and the bushing-member rotating member.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
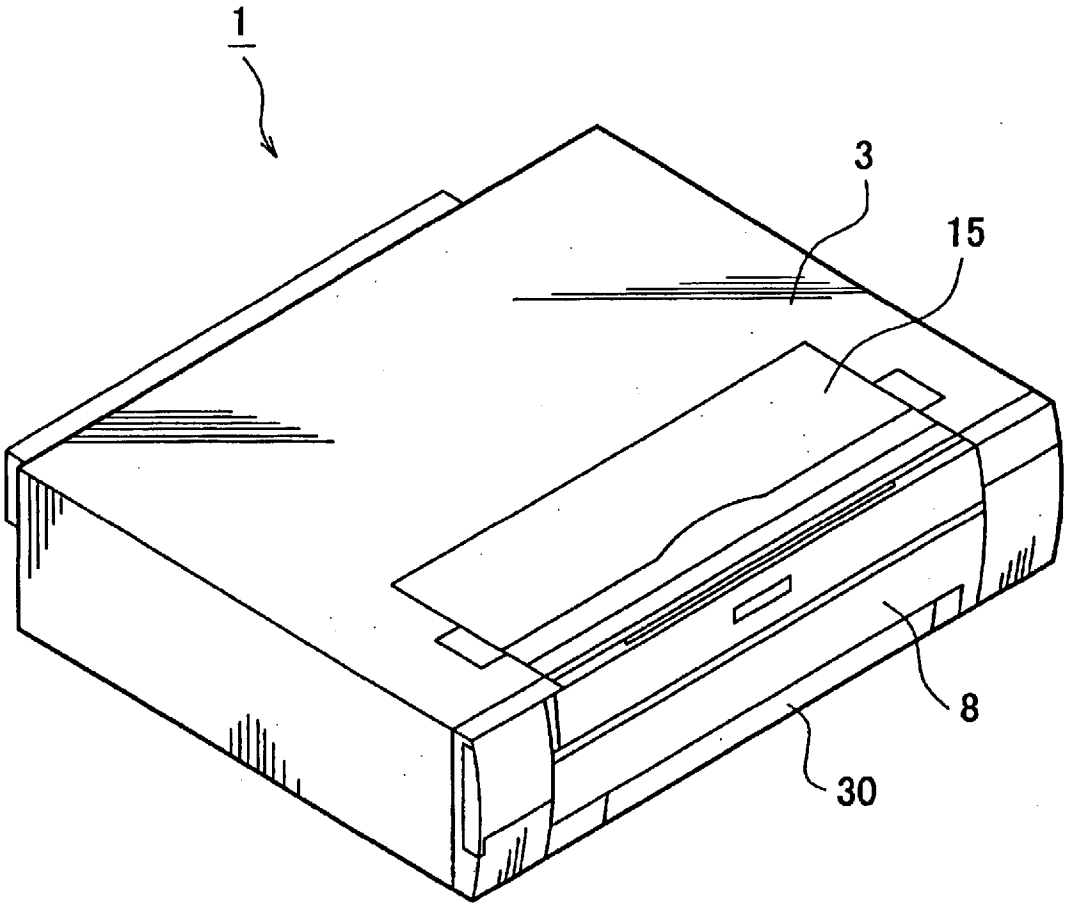
FIG. 1 is a perspective view of a printer according to the present invention, showing its appearance.
Figure 2:
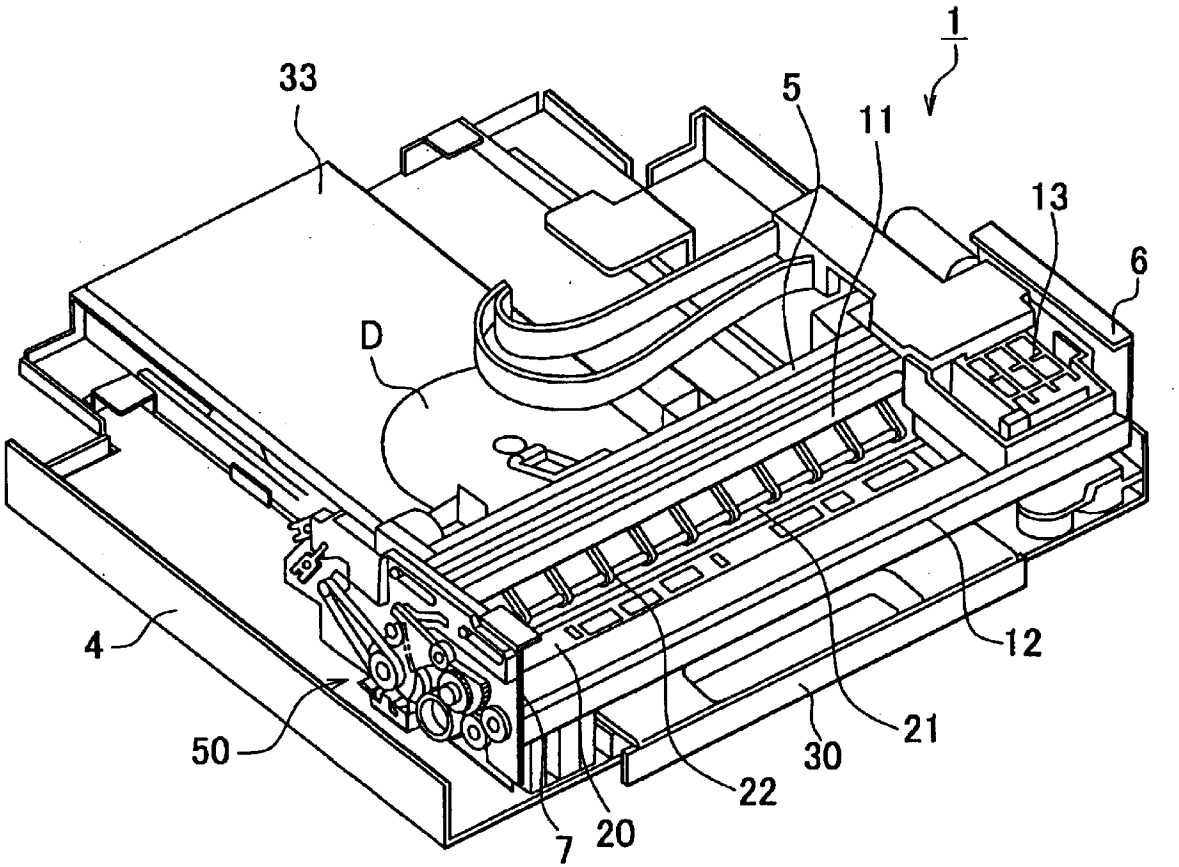
FIG. 2 is a perspective view of the printer according to the present invention, showing its inside and appearance.

First, an ink-jet printer (hereinafter, simply referred to as a printer) 1 as an exemplary recording apparatus or an exemplary liquid ejection apparatus according to the present invention is generally described referring to FIGS. 1–3. FIG. 1 is a perspective view showing an appearance of the printer 1; FIG. 2 is a perspective view showing the appearance while an outer housing is removed; and FIG. 3 is a cross-sectional view of the printer 1 seen from the side.

As shown in FIG. 1, the printer 1 has a box-like shell and is formed to have a size approximately the same as a video tape recorder (VTR), considering a case where it is placed on a TV cabinet or the like. The appearance of the printer 1 is generally formed by a box-like housing 3 and a front cover 8 provided on the front face of the housing 3. The front cover 8 is provided to be rotatable between an opened state (used state, not shown) where it opens toward the front and a closed state (unused state) where it is closed, as shown in FIG. 1. In the opened state, recording paper after recording has been performed thereon can be discharged and a disk tray 33 (see FIG. 2) can be got in and out. Under the front cover 8, a paper-feed tray 30 is provided to be attached and removed freely. When the paper-feed tray 30 is pulled toward the front so as to be removed, recording paper can be set in the paper-feed tray 30. An ink cartridge 15 is provided above the front cover 8, which includes a plurality of ink cartridges 16 (see FIG. 3) that are arranged in a width direction of the printer 1 to be freely attached and removed.

Figure 3:
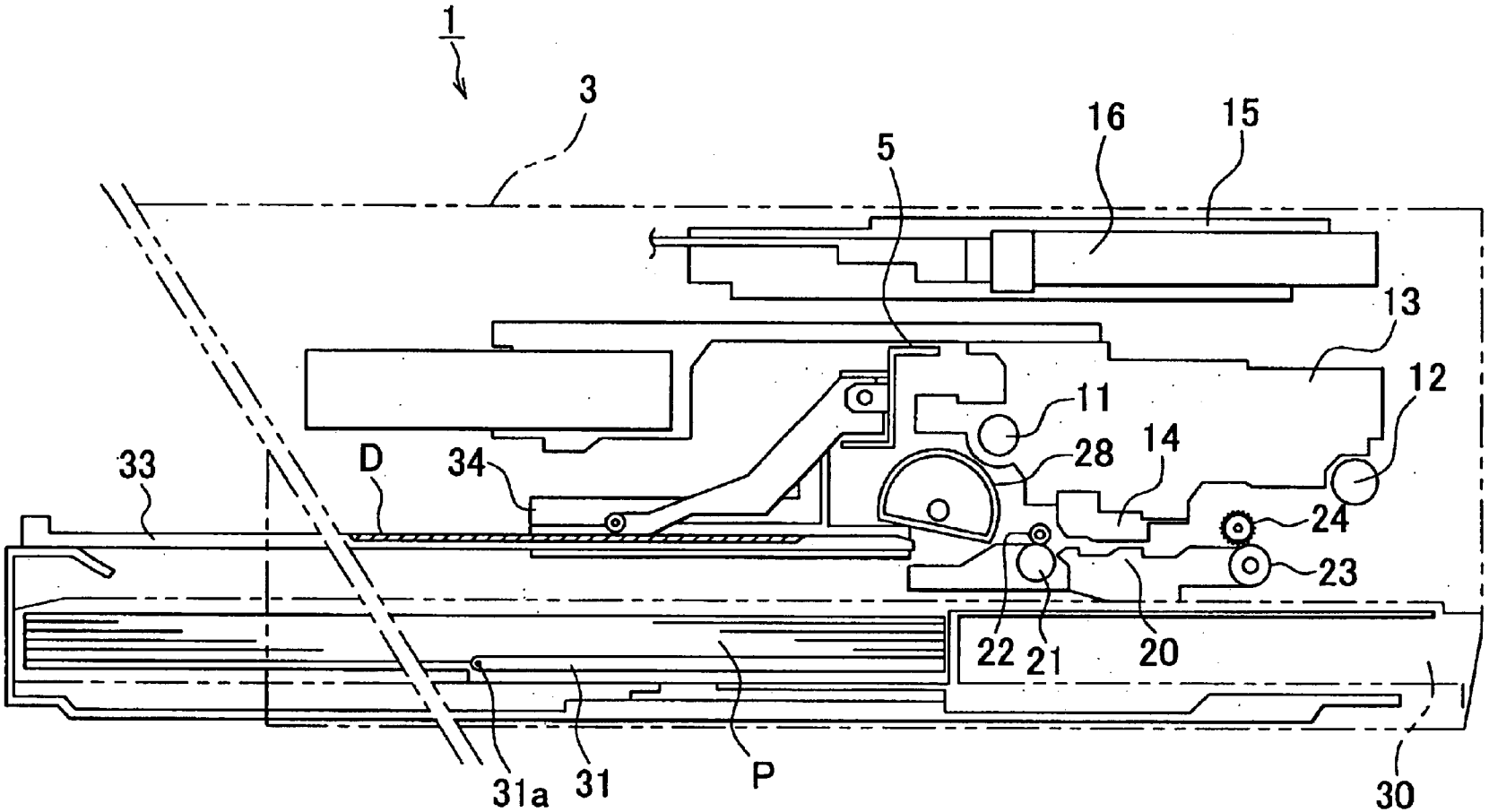
FIG. 3 is a cross-sectional view of the printer according to the present invention, seen from the side thereof.

Referring to FIGS. 2 and 3, the internal structure of the printer 1 is generally described. As shown in FIG. 2, the main body of the printer 1 is formed by a lower chassis 4, a main frame 5 extending in the width direction of the main body of the printer 1 (main scanning direction), and a right side frame 6 and left side frame 7 provided on both sides of the main frame 5 to stand, that are parallel to a depth direction of the main body of the printer 1 (sub-scanning direction). Between the right side frame 6 and the left side frame 7 are provided a main carriage guide shaft 11 and a sub-carriage guide shaft 12 both extending in the main scanning direction, with a predetermined space therebetween.

The main carriage guide shaft 11 and the sub-carriage guide shaft 12 are used for guiding a carriage 13 in the main scanning direction. The main carriage guide shaft 11 is inserted through the back portion of the carriage 13, while the sub-carriage guide shaft 12 supports the front portion of the carriage 13 from beneath the carriage 13, thereby a distance between a recording head 14 (see FIG. 3) and recording paper P is defined. This distance is called as a paper gap and is simply referred to as PG hereinafter. A gap adjusting device 50 according to the present invention is provided on the left side frame 7 and adjusts PG by adjusting the level (height) of the main carriage guide shaft 11 and the sub-carriage guide shaft 12. Please note that bushing members 67 and 68 of the gap adjustment device 50, that will be described later, are provided on the right side frame 6. The details of the PG adjustment will be described later.

Referring to FIG. 3, a transfer path of the recording paper P and that of the disk tray 33 are described. The printer 1 includes the paper-feed tray 30 that is attached and removed freely at the bottom of the printer 1, as described above. The paper-feed tray 30 allows a plurality of sheets pf recording paper P to be stacked therein, and has a hopper 31 at the bottom. The hopper 31 is provided to pivotally move around a pivotal axis 31*a*, and pushes up the stack of the recording paper P from beneath of the recording paper P so as to bring that stack into contact with a feed roller 28 provided above.

The feed roller 28 has a substantially D-shape seen from the side thereof, and includes a high friction member (e.g. a rubber member) at its outer circumference. When a sheet of recording paper P is fed, the uppermost sheet of the stack of recording paper P, that is in contact with an arc portion of the feed roller 28, is fed toward the downstream (right in FIG. 3) by rotation of the feed roller 28. Below the feed roller 28 is provided a friction-separation member (not shown) that is pushed against the feed roller 28 to be in contact with the arc portion of the feed roller 28. The uppermost sheet of the recording paper P that is to be fed is separated from the other sheets of recording paper P by being nipped by the friction-separation member and the feed roller 28.

In the downstream of the feed roller 28, a transfer driving roller 21 that is driven by a transfer motor 40 (see FIG. 4) to rotate. A transfer driven roller 22 is also provided in the downstream of the feed roller 28, which is in contact with the transfer driving roller 21 and is rotated with the rotation of the transfer driving roller 21. When the transfer driving roller 21 is driven to rotate while the recording paper P is nipped between the transfer driving roller 21 and the transfer driven roller 22, the recording paper P is transferred to a position under the recording head 14. In the downstream of the transfer driving roller 21, the recording head 14 and a platen 20 are provided above and below the path of the recording paper P to be opposed to each other. While the plate 20 supports the recording paper P thus transferred from beneath, the recording head 14 ejects drops of ink as "liquid" toward the recording paper P, thereby performing recording. Although the recording head 14 is provided at the bottom of the carriage 13, the carriage 13 that can reciprocate in the main scanning direction includes no ink cartridge. Instead, a plurality of ink cartridges 16 are placed above the main scanning direction of the carriage 13 to be freely attached and removed, while being arranged in the main scanning direction, as described above. Ink is supplied to the carriage 13 through ink tubes (not shown).

In the downstream of the recording head 14 are provided a discharge driving roller 23 that is driven by the transfer motor 40 to rotate and a discharge driven roller 24 that is in contact with the discharge driving roller 23 and is rotated by the rotation of the roller 23. The recording paper P is discharged to the outside of the printer 1 when the discharge driving roller 23 is driven to rotate while the recording paper P is sandwiched between the discharge driving roller 23 and the discharge driven roller 24.

On the other hand, the disk tray 33 in which an optical disk D such as a DVD (Digital Versatile Disk) can be placed is arranged above the paper-feed tray 30. The disk tray 33 is provided with a rack (not show) at its side. Rotation of a pinion (not shown) engaging with that rack allows straightforward movement of the disk tray 33 in the substantially horizontal direction. In recording for an optical disk D, the disk tray 33 is transferred by the moving means mentioned above, i.e., the rack and pinion, until a leading edge of the disk tray 33 reaches a position between the transfer driving roller 21 and the transfer driven roller 22 where they can nip the disk tray 33, and thereafter the disk tray 33 is transferred by the driving force caused by the rotation of the transfer driving roller 21 at a predetermined pitch to a position under the recording head 14 where the recording is performed.

Figure 4:
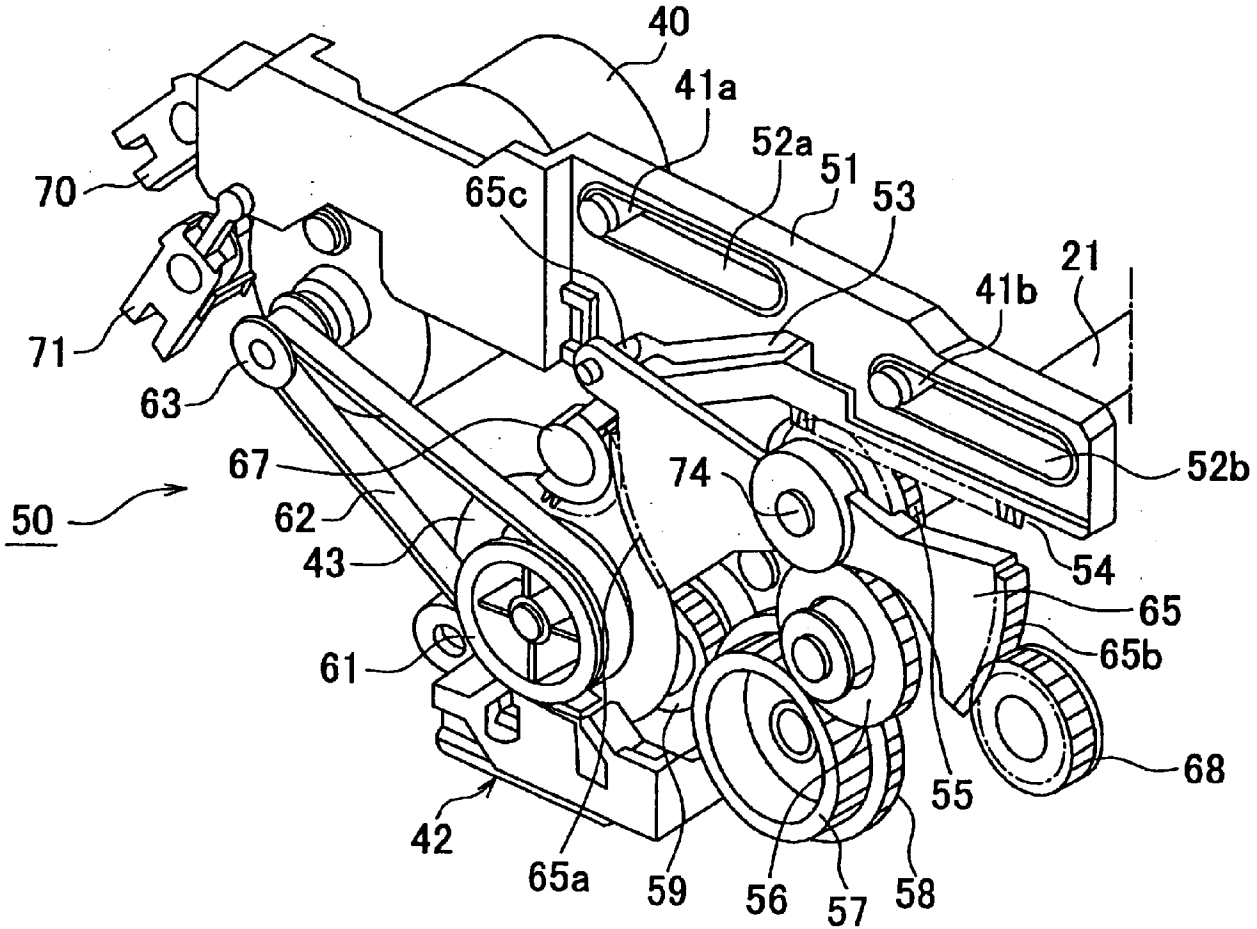
FIG. 4 is a perspective view of a gap adjusting device according to the present invention.
Figure 5:
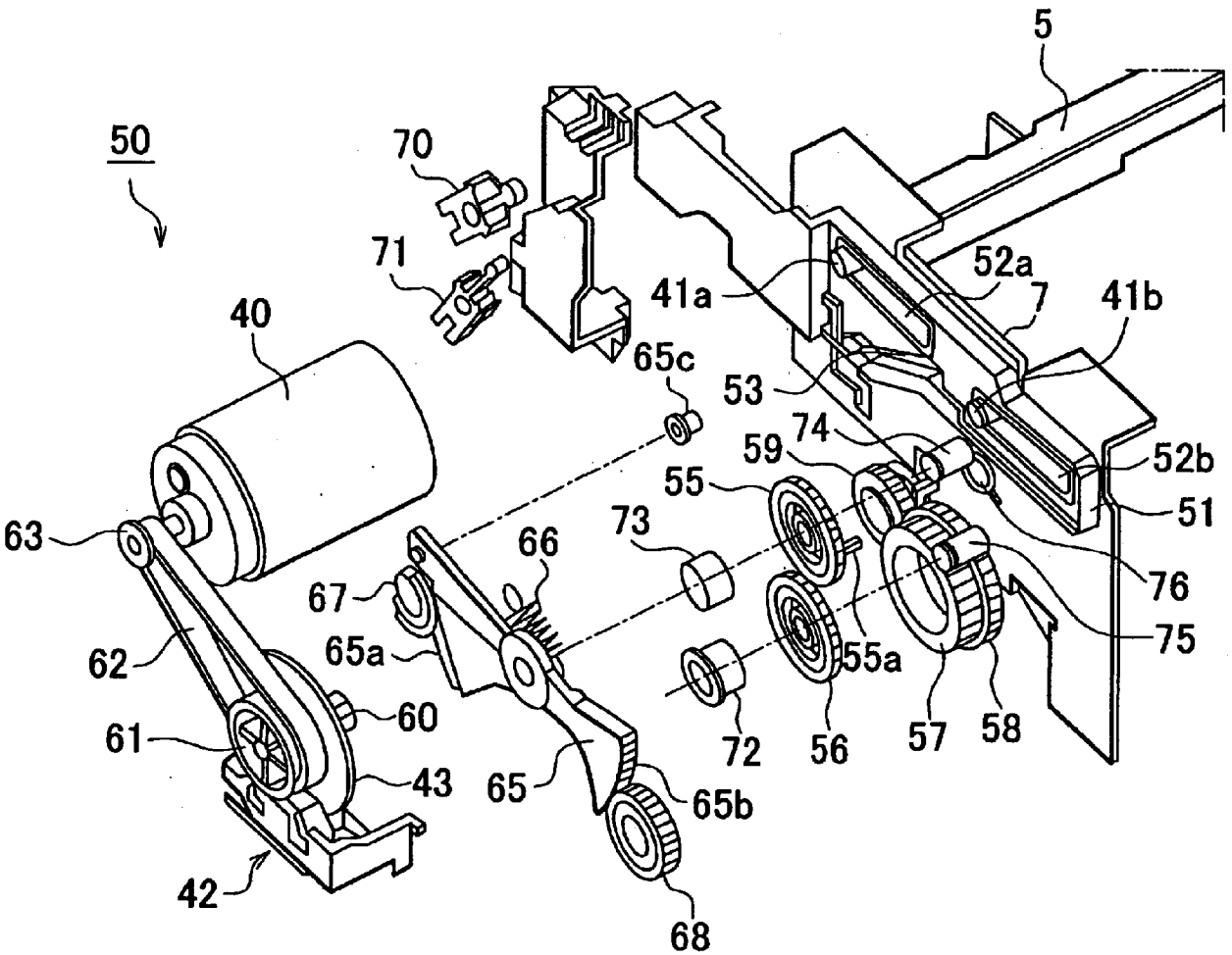
FIG. 5 is an exploded perspective view of the gap adjusting device according to the present invention.
Figure 6:
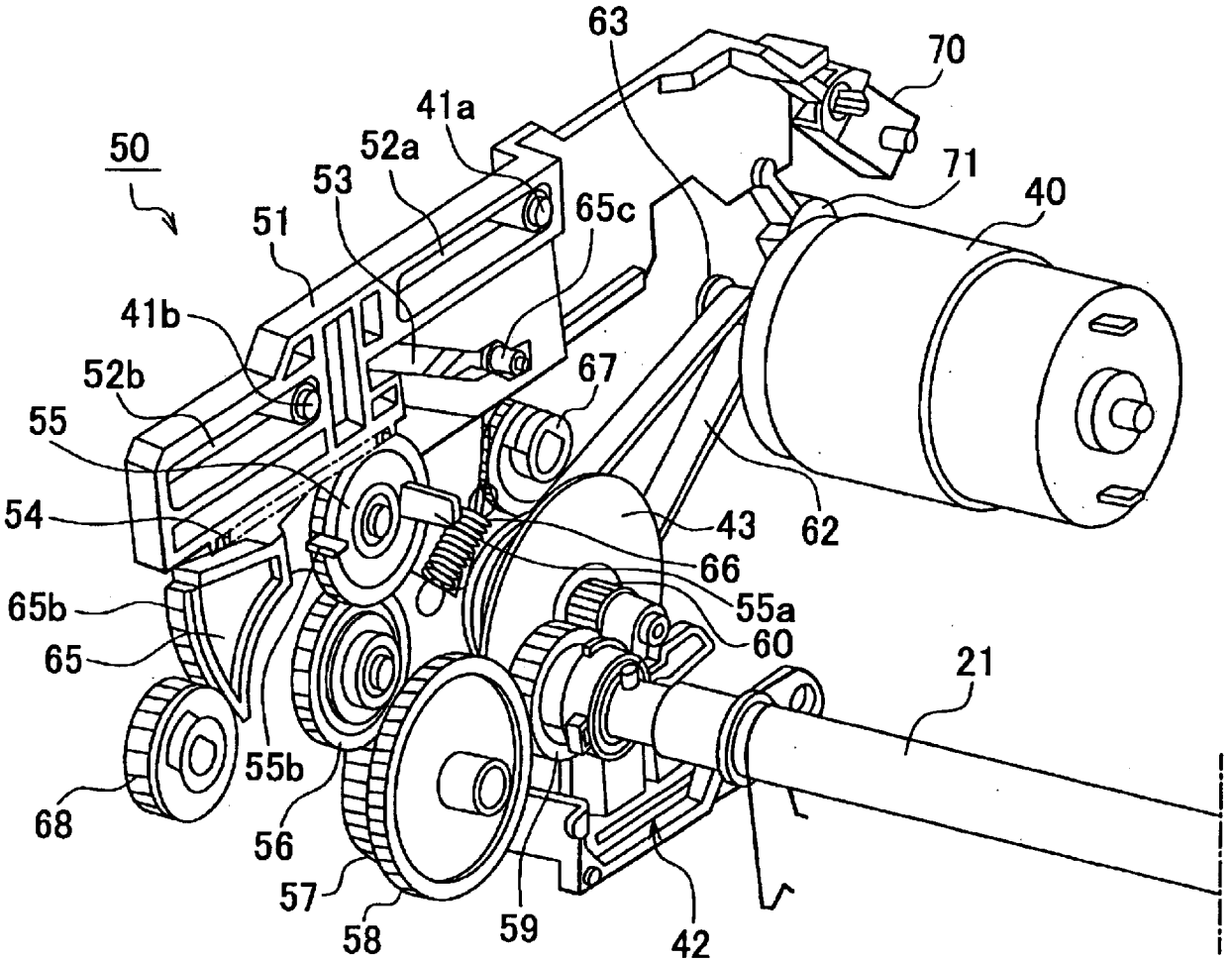
FIG. 6 is a perspective view of the gap adjusting device according to the present invention.
Figure 7:
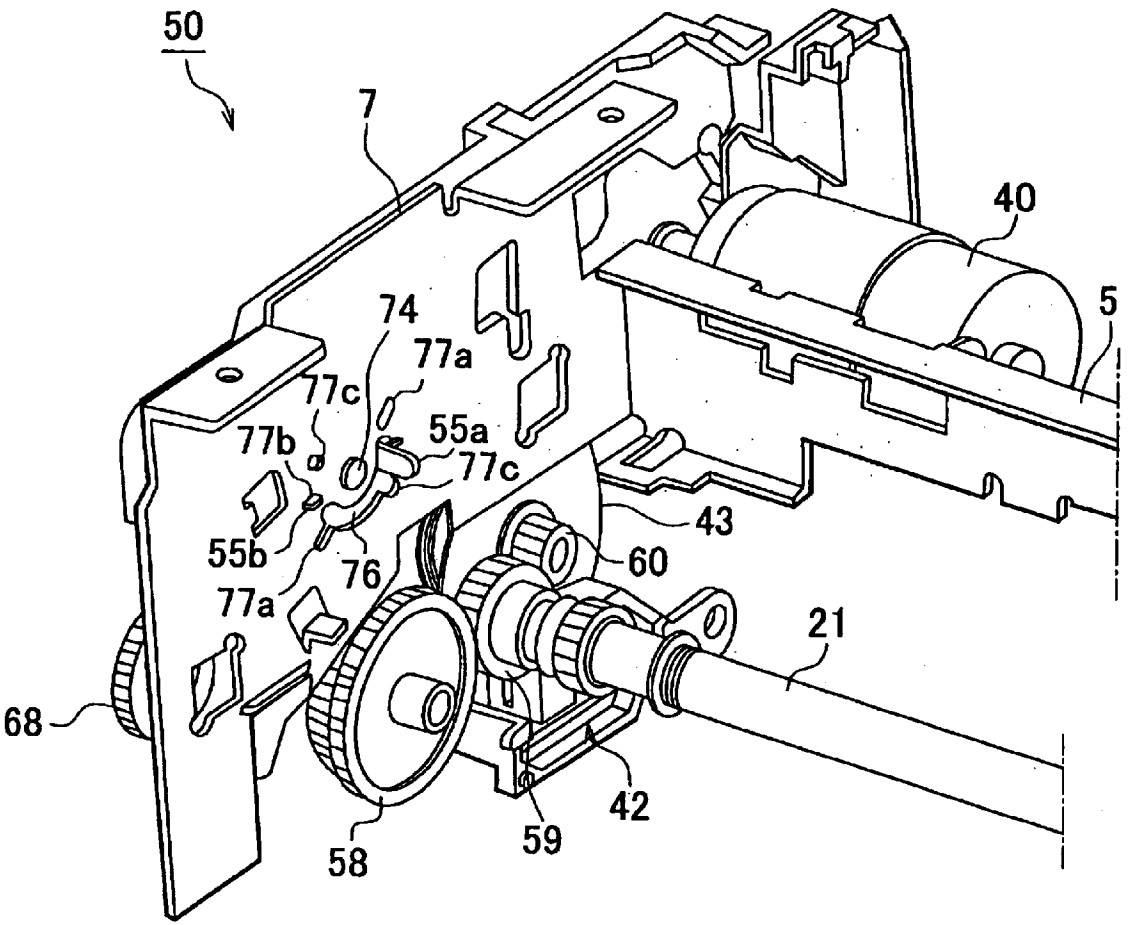
FIG. 7 is a perspective view of the gap adjusting device according to the present invention.
Figure 8:
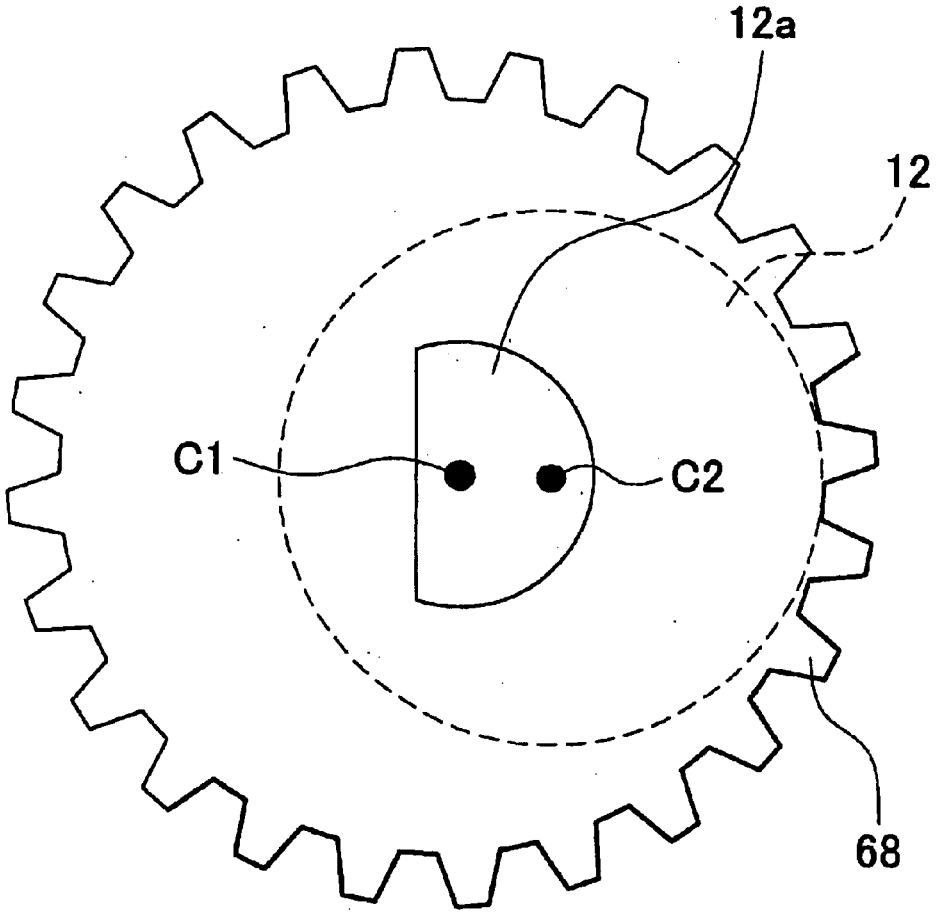
FIG. 8 shows a positional relationship between a bushing member and a carriage guide shaft.
Figure 9:
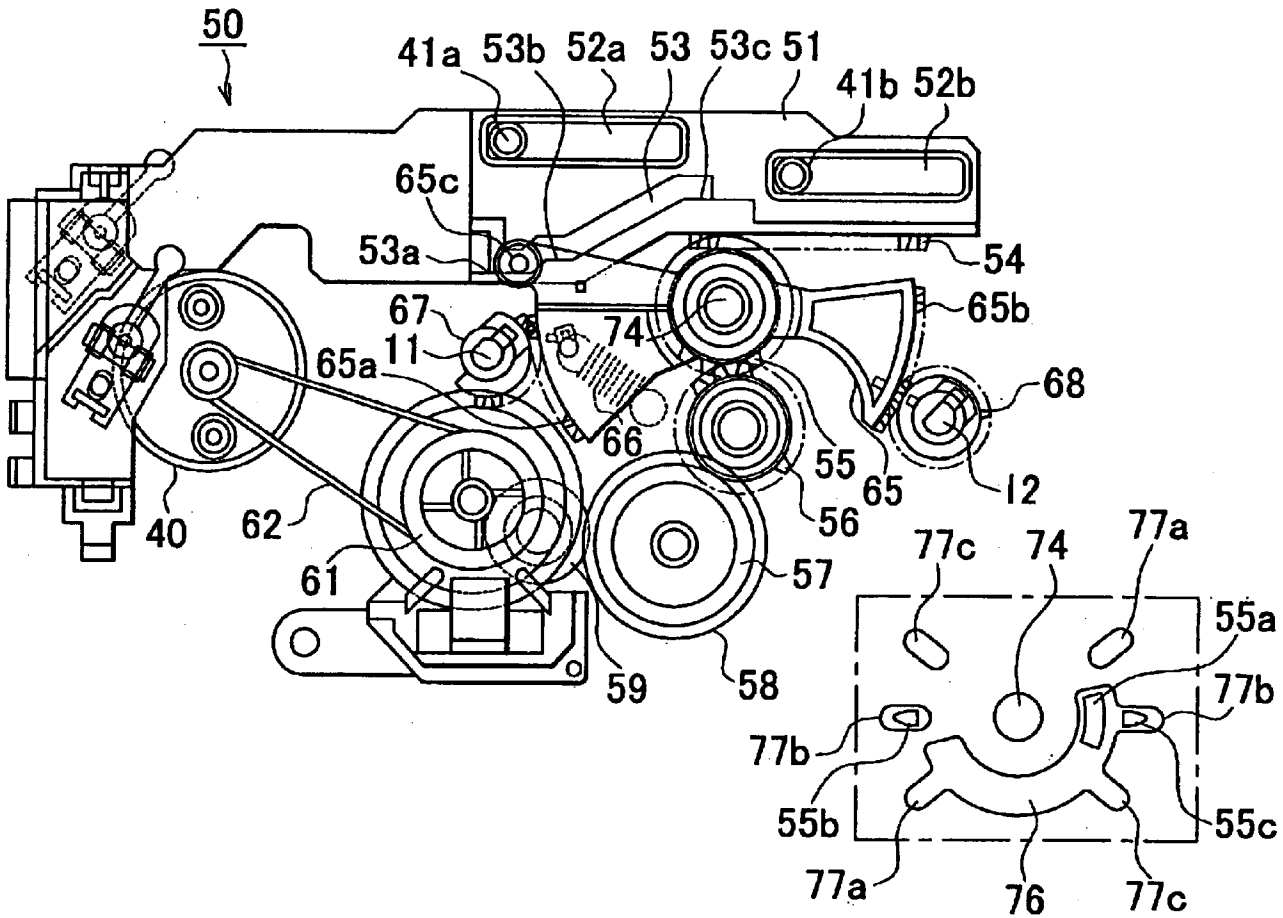
FIG. 9 is a font view of the gap adjusting device according to the present invention.
Figure 10:
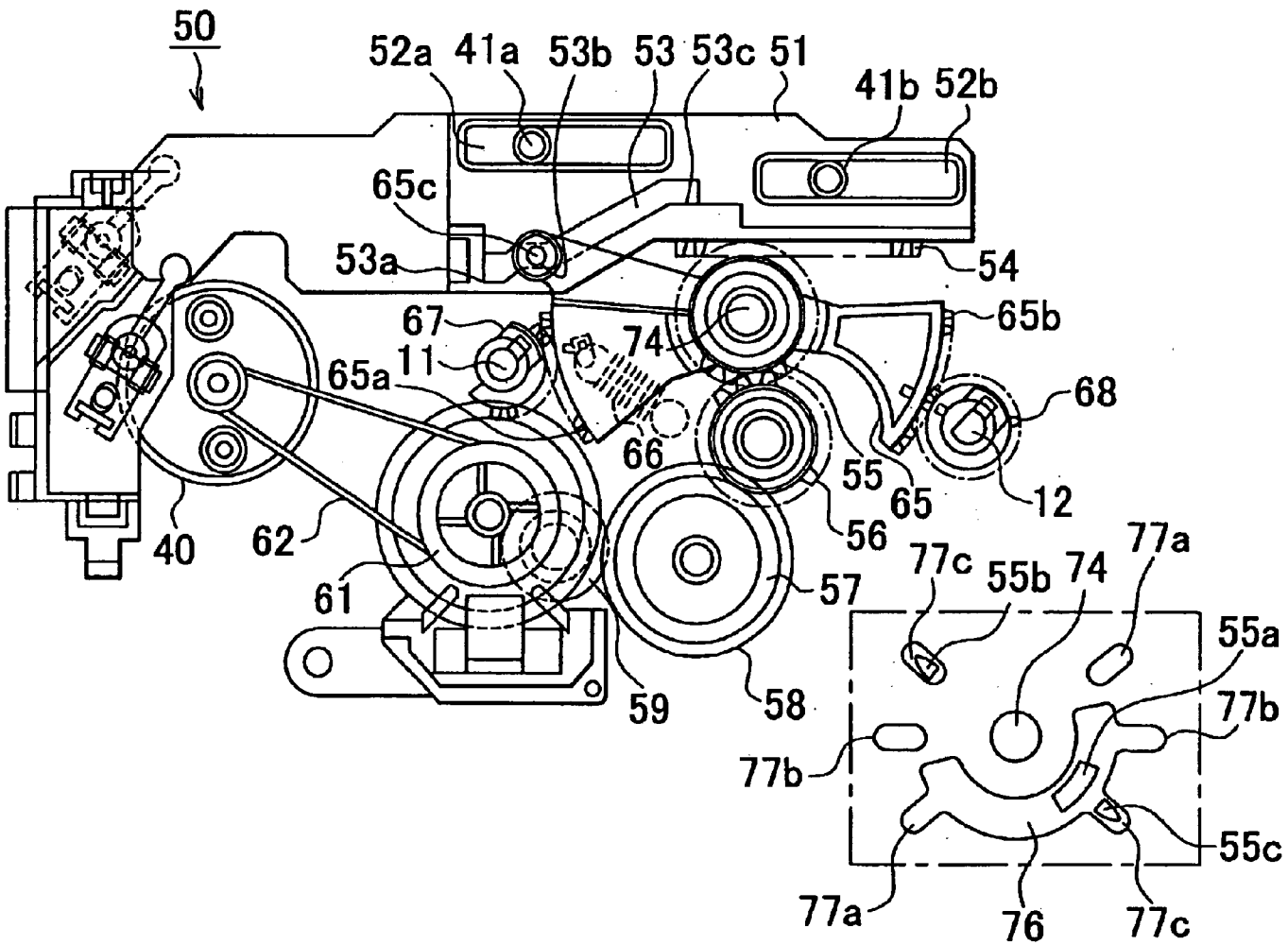
FIG. 10 is a font view of the gap adjusting device according to the present invention.
Figure 11:
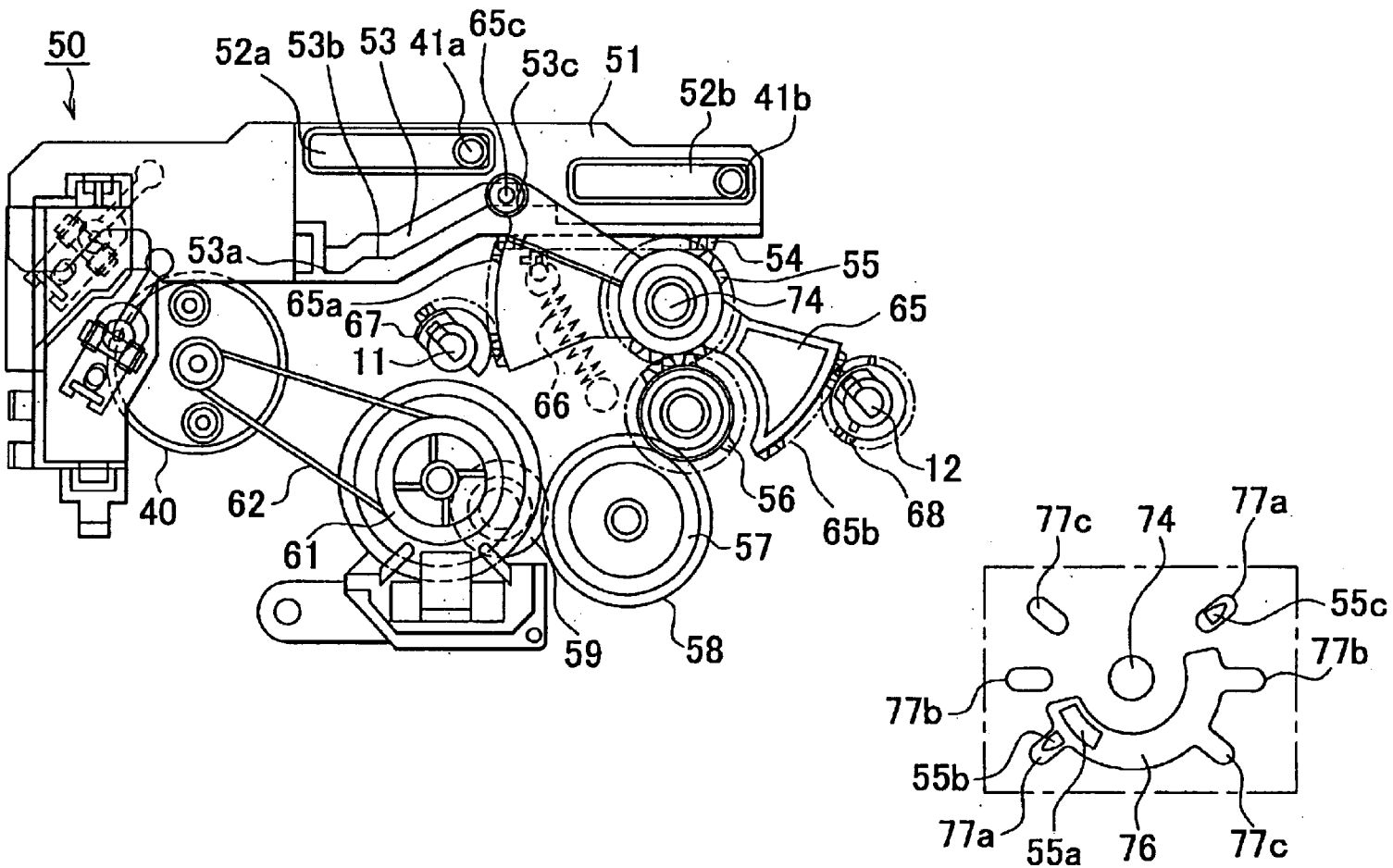
FIG. 11 is a font view of the gap adjusting device according to the present invention.

Next, the structure of the gap adjusting device 50 for adjusting PG is described in detail, referring to FIGS. 4–15. FIG. 4 is a perspective view showing the appearance of the gap adjusting device 50; FIG. 5 is an exploded perspective view thereof; FIGS. 6 and 7 are perspective views showing the appearance of the gap adjusting device 50 seen from the back (FIG. 6 shows a state where the left side frame 7 is removed, while FIG. 7 shows a state where the left side frame 7 is attached); FIG. 8 is a diagram showing a positional relationship between a center of rotation of a bushing member and a shaft center of the carriage guide shaft; and FIGS. 9–11 are front views of the gap adjusting device 50, that show transitions of an operation of the gap adjusting device 50. FIGS. 12–15 are control flows when PG is switched.

As shown in FIGS. 4 and 5, the gap adjusting device 50 includes bushing members 67 and 68. The bushing member 67 is attached to a shaft end of the main carriage guide shaft 11 on the left-side-frame side. The bushing member 68 is attached to a shaft end of the sub-carriage guide shaft 12 on the left-side-frame side. The busing members 67 and 68 are attached to the left side frame 7 via intermediate parts (not shown) to be rotatable.

The sub-carriage guide shaft 12 is described as an example. As shown in FIG. 8, the shaft end of the sub-carriage guide shaft 12 is formed to have a half-moon attachment portion (protrusion) 12*a*. This attachment portion 12*a* is inserted into a half-moon fitting hole formed in the bushing member 68 while being pushed against the fitting hole. Please note that the reference numerals $C_1$ and $C_2$ denote the center of rotation of the bushing member 68 and the shaft center of the sub-carriage shaft 12, respectively. As shown in FIG. 8, the center of rotation $C_1$ and the shaft center $C_2$ are arranged not to be coincident with each other. Therefore, when the bushing member 68 provided on the left side frame 7 is rotated, the height of the sub-carriage guide shaft 12 is changed, thus adjusting PG. A similar mechanism can be applied to the bushing member 67 attached to the main carriage guide shaft 11. Thus, the gap adjusting device 50 transmits the rotation of the transfer motor 40 via a gear arrangement described later to the bushing members 67 and 68 so as to rotate the bushing members 67 and 68 in synchronization with each other, thereby adjusting PG while maintaining the distance between the main carriage guide shaft 11 and the sub-carriage guide shaft 12 in its height direction.

In this embodiment, the center of rotation $C_1$ of the bushing member 68 (bushing member 67) is positioned on the left side of the shaft center $C_2$ Of the sub-carriage guide shaft 12 (main carriage guide shaft 11), seen from the front of the bushing member, as shown in FIG. 8. Therefore, a force causing the bushing member 68 (bushing member 67) to rotate in a clockwise direction in FIG. 8 acts on the bushing member 68 (bushing member 67) because of the weights of the sub-carriage guide shaft 12 (main carriage guide shaft 11) and the carriage 13.

The bushing member 67 and 68 are formed to be capable of engaging with associated gears at their outer circumferences, respectively. The bushing members 67 and 68 engage with gear portions 65*a* and 65*b* as "bushing-member engagement portions" in an intermediate gear 65 as a "bushing-member rotating member". The intermediate gear 65 is supported by a shaft 74 to be rotatable around the shaft 74, and includes a boss 65*c* near the gear portion 65*a*, which protrudes toward the left side frame 7.

The boss 65*c* is inserted into a cam groove 53 formed in a slidable member 51, that extends in a sliding direction of the slidable member 51 and has a stairway-like shape, in such a manner that the boss 65*c* is movable in the cam groove 53. The boss 65*c* is displaced in the cam groove 53 in accordance with a sliding operation of the slidable member 51, thus causing the rotation of the intermediate gear 65. The slidable member 51 is attached so as to slide along the surface of the left side frame 7 in a direction horizontal to the depth direction of the printer 1 (i.e., the sub-scanning direction). More specifically, the left side frame 7 is provided with guide pins 41*a* and 41*b*, while the slidable member 51 is provided with an elongate holes 52*a* and 52*b* that extend horizontally when seen from the front the slidable member 51. By attaching the slidable member 51 in such a manner that the guide pins 41*a* and 41*b* are inserted into the elongate holes 52*a* and 52*b*, respectively, the slidable member 51 can slide horizontally.

A rack 54 is formed on the lower surface of the slidable member 51. The rack 54 engages with a pinion 55. To the pinion 55, a power is transmitted via gears 58 and 57 integrally formed with each other, and a gear 56 in that order. The gear 58 engages with a transfer-driving-roller gear 59 attached to a shaft end of the shaft of the transfer driving roller 21. The transfer-driving-roller gear 59 engages with a gear 60 (see FIG. 6). The gear 60 is formed integrally with a pulley 61. An endless belt 62 is put around the pulley 61 and a pinion 63 attached to the rotation shaft of the transfer motor 40. Thus, the gear arrangement mentioned above (power transmission device) transmits a rotational driving force of the transfer motor 40 to the pinion 55. That driving force is then converted into the sliding operation of the slidable member 51, thus rotating the bushing member 67 and 68 to change PG.

A rotary encoder includes a disc scale 43 that rotates with the pulley 61 and has a plurality of slits on its outer circumference, and a light-emitting and light-receiving portion 42 that emits light to the slits of the disc scale 43 and receives that light. That rotary encoder is connected to a controller (not shown) of the printer 1 and can detect the rotation amount of the pulley 61, i.e., the rotation amount of the transfer driving roller 21, and the rotation amount of the gear included in the gap adjusting device 50 on a per-step basis.

Next, a position of PG (gap position) and a PG maintaining means for maintaining it are described. The cam groove 52 to which the boss 65 is inserted has a stairway-like shape by including flat portions 53*a*, 53*b* and 53*c* as "PG-unchanging portion" and a slope portion as "PG-changing portion". The boss 65*c* rotates the intermediate gear 65 while moving in the slope portion, whereas the boss 65*c* does not rotate the intermediate gear 65 while moving in the flat portions 53*a*, 53*b* and 53*c*. Therefore, the flat portions 53*a*, 53*b* and 53*c* serve as portions that do not change PG and can keep PG constant even if the slidable member 51 slides slightly. The gap adjusting device 50 has three PG positions because of the existence of the three flat portions 53*a*, 53*b* and 53*c* and switches these PG positions stepwise.

In the present embodiment, a lock means for holding the sliding operation of the slidable member 51 is used as the PG maintaining means. This lock means restrains the rotation of the pinion 55 engaging with the rack 54 formed in the slidable member 51, thereby maintaining PG. The lock means for restraining the sliding operation of the slidable member 51 by restraining the rotation of the pinion 55.

The pinion 55 has an engagement pin 55*a* and engagement protrusions 55*b* and 55*c* that are formed on its surface opposed to the left side frame 7. The engagement pin 55*a* is formed to protrude from an annular hole 76 (see FIGS. 5 and 9) toward the main scanning region of the carriage 13 (right side of the left side frame 7). The engagement protrusions 55*b* and 55*c* are formed in such a manner that they can be inserted into fitting holes 77*a*, 77*b* and 77*c* (described in detail later) provided in the left side frame 7 to correspond to the respective PG positions.

The pinion 55 is provided to be rotatable around a shaft 74 and be slidable in a direction of the shaft center line. Moreover, the pinion 55 is forced toward the left side frame 7 by a forcing member 73. The sliding operation of the pinion 55 is achieved by the forcing member 73 and the carriage 13. More specifically, the engagement pin 55*a* can engage with the carriage 13, and the carriage 13 pushes the engagement pin 55*a* when the carriage 13 moves toward the left side frame 7 (hereinafter, the position of the carriage 13 at this time is called as "pushed position"), thus causing the pinion 55 to slide away from the left side frame 7 against the force applied by the forcing member 73.

While the carriage 13 does not engage with the engagement pin 55*a*, the pinion 55 is pushed and is in contact with the left side frame 7 by the force applied by the forcing member 73. In this state, the protrusions 55*b* and 55*c* fit into the fitting holes 77*b* and 77*b* formed in the left side frame 7, respectively, as shown in FIG. 9, thus restraining the rotation of the pinion 55. Therefore, the sliding operation of the slidable member 51 is restrained, maintaining PG. This means is the lock means for locking the slidable member 51. In such a locked state, the pinion 55 is disengaged from the gear 56. In other words, the pinion 55 is disengaged from the gear arrangement. Therefore, the power is not transmitted.

On the other hand, when the carriage 13 pushed the engagement pin 55*a*, the pinion 55 slides away from the left side frame 7, thereby engaging with the gear 56. In this state, the protrusions 55*b* and 55*c* do not fit into any of the fitting holes 77*a*, 77*b* and 77*c* formed in the left side frame 7. Therefore, the pinion 55 is allowed to rotate in this state. Once the pinion 55 was disengaged from the positions of the fitting holes 77*a*, 77*b* or 77*c*, the protrusions 55*b* and 55*c* slid on the surface of the left side frame 7 while being pressed toward the surface of the left side frame 7, even after the carriage 13 is moved away from the left side frame 7. Then, the protrusions 55*b* and 55*c* fit into any of the fitting holes 77*a*, 77*b* and 77*c* to be locked and therefore the pinion 55 is disengaged from the gear arrangement so as to be placed in the state where the pinion 55 does not transmit the power.

The thickness of the rack 54 is set to be thicker so as to allow engagement of the pinion 55 and the rack 54 irrespective of the sliding operation of the pinion 55. Moreover, the gear 56 that can engage with the pinion 55 is provided to be slidable in a direction of the rotation shaft like the pinion 55 and is forced toward the left side frame 7 by a forcing member 72 (FIG. 5). Thus, when the pinion 55 was pushed by the carriage 13, the gear 56 can move away from the left side frame 7 even if the gear 56 does not engage with the pinion 55. Then, the pinion 55 and the gear 56 engage with each other normally by the rotation of the pinion 55. Therefore, it is possible to prevent damage of the pinion 55 or the gear 56 or the like.

In the present embodiment, one engagement pin 55*a* is formed on the pinion 55. Alternatively, two or more engagement pins 55*a* may be provided. In this case, when the pinion 55 slides along the rotation shaft 74, parallel forces can be applied to the rotation shaft 74. Thus, it is possible for the pinion 55 to slide along the rotation shaft 74 more smoothly.

Next, PG switching control sequences are described referring to FIGS. 12–15.

Figure 12:
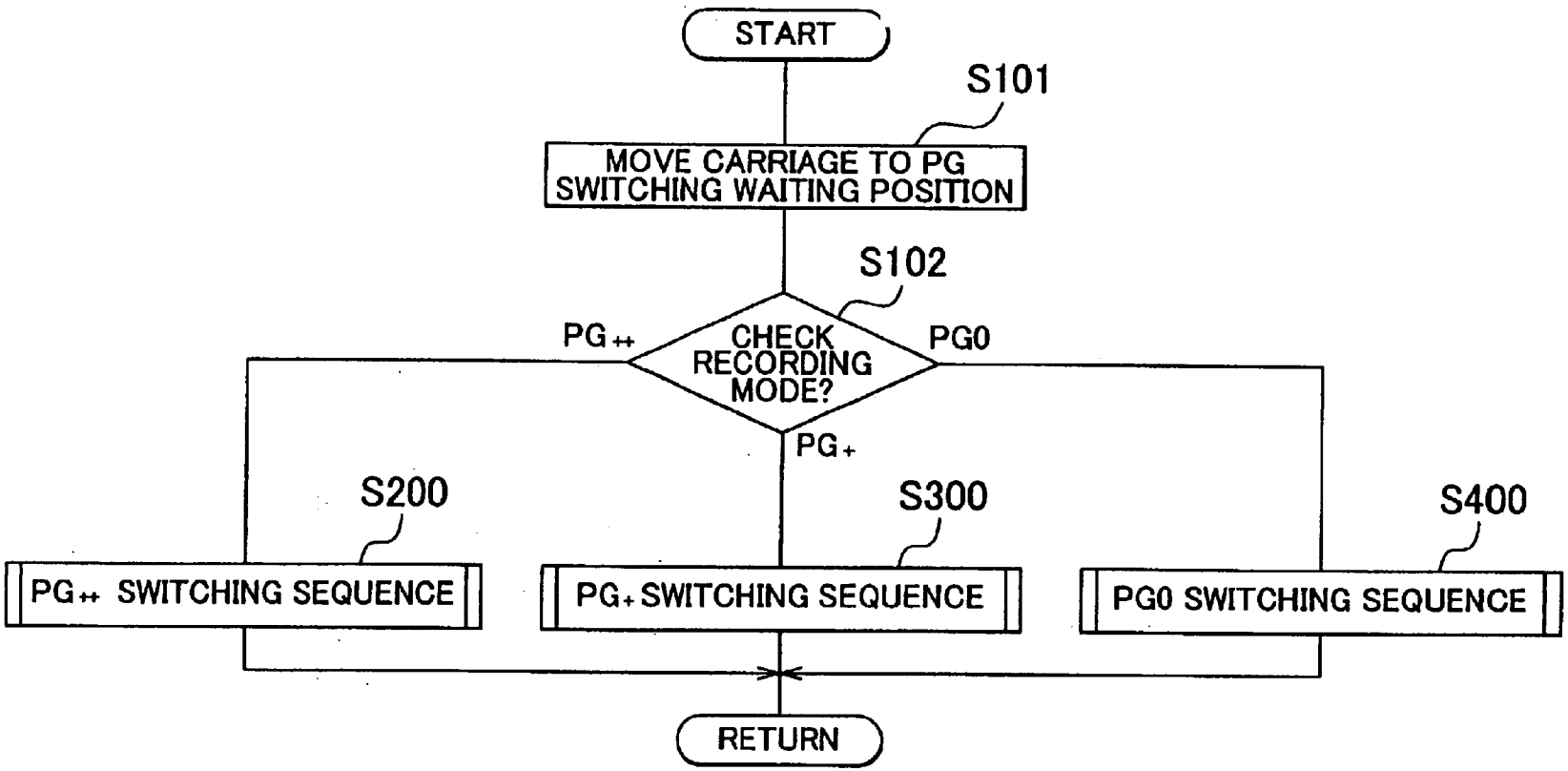
FIG. 12 shows a control flow when PG is switched.
Figure 13:
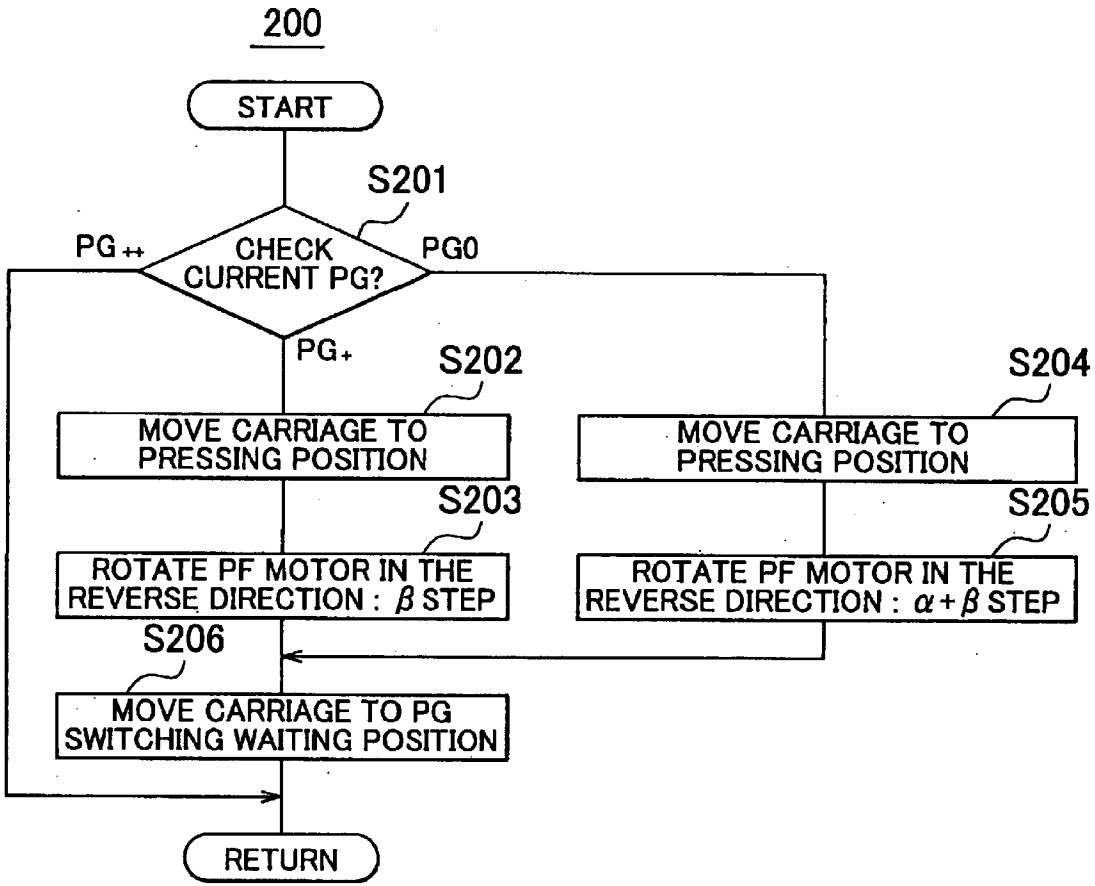
FIG. 13 shows a control flow when PG is switched.

Referring to FIG. 12, in a case where a PG switching operation is performed, the carriage 13 is moved to a PG switching waiting position (Step S101). The PG switching waiting position is the position of the carriage 13 when the carriage 13 does not engage with the engagement pin 55*a* but comes in contact with the engagement pin 55*a*, or the position when the carriage 13 has not pushed the engagement pin 55*a* yet although the carriage 13 engages with the engagement pin 55*a*.

Then, it is determined which one of "PG++", "PG+", and "PG0" recording modes is to be performed (Step S102), and the switching sequence corresponding to the respective recording mode is executed based on the determination (Step S200, S300 or S400). The "PG++" recording mode is a mode for performing recording for the disk tray 33 described above, in which PG is maximum. The "PG+" recording mode is a mode for performing recording for plain paper, in which PG is set to be an intermediate value. The "PG0" recording mode is a mode for performing printing for exclusive paper having a coating layer thereon, in which PG is minimum. The reason for setting PG for plain paper larger than that for exclusive paper is that the effect of a so-called Cockling phenomenon, in which paper absorbing ink drops becomes rippling, is larger in plain paper than in exclusive paper, thus increasing the apparent thickness of the plain paper. In some cases, plain paper may come in contact with the recording head 14 because of the Cockling phenomenon.

Next, each switching sequence is described. In the PG++ switching sequence 200 shown in FIG. 13, current PG is checked (Step S201). When current PG is "PG++", no process is executed and the operation goes back to a control routine at a higher level. FIG. 11 shows a state in which the gap adjusting device 50 is set in the "PG++" recording mode. In the "PG++" recording mode, the slidable member 51 is at the leftmost position seen from the front. The boss 65*c* in the cam groove 53 is located the uppermost flat portion 53*c*, and the protrusions 55*b* and 55*c* formed in the pinion 55 fit into the fitting holes 77*a*. FIGS. 9–11 show a region around the rotation shaft 74 when the gap adjusting device 50 is seen from the back (corresponding to a plan view of the perspective view of FIG. 7) in the lower-right hand corner.

When current PG is "PG+" (shown in FIG. 10), the carriage 13 is moved to the pushing position (Step S202) and the transfer motor 40 is rotated in the reverse direction by β steps (Step S203), thereby bringing the carriage 13 to the PG switching waiting position (Step S206). In this operation, the rotation of the transfer motor 40 in the reverse direction rotates the protrusions 55*b* and 55*c* in a counterclockwise direction in the lower-right part of FIG. 10. In order for the protrusion 55*c* to go up to the next fitting hole 77*a* from the state shown in FIG. 10, the transfer motor 40 rotates by β steps. Similarly, in order for the protrusion 55*c* to go down from the fitting hole 77*b* to the next fitting hole 77*c*, the transfer motor 40 rotates by β steps.

As described above, from the state shown in FIG. 10, the slidable member 51 slides left and the boss 65*c* in the cam groove 53 moves from the intermediate flat portion 53*b* to the next flat portion 53*c*. Moreover, the protrusions 55*b* and 55*c* move from the fitting holes 77*b* and 77*b* to the fitting holes 77*a* and 77*a* and fit into them (shown in FIG. 11).

Returning to FIG. 13, when current PG is "PG0" (in a state shown in FIG. 9), the carriage 13 is moved to the pushing position (Step S204) and the transfer motor 40 is rotated in the reverse direction by α+β steps (Step S205). Thus, the slidable member 51 slides left, the boss 65*c* in the cam groove 53 moves from the lowermost flat portion 53*a* to the uppermost flat portion 53*c* and the protrusions 55*b* and 55*c* formed on the pinion 55 move from the fitting holes 77*c* and 77*c* to the fitting holes 77*a* and 77*a* and fit into them.

Figure 14:
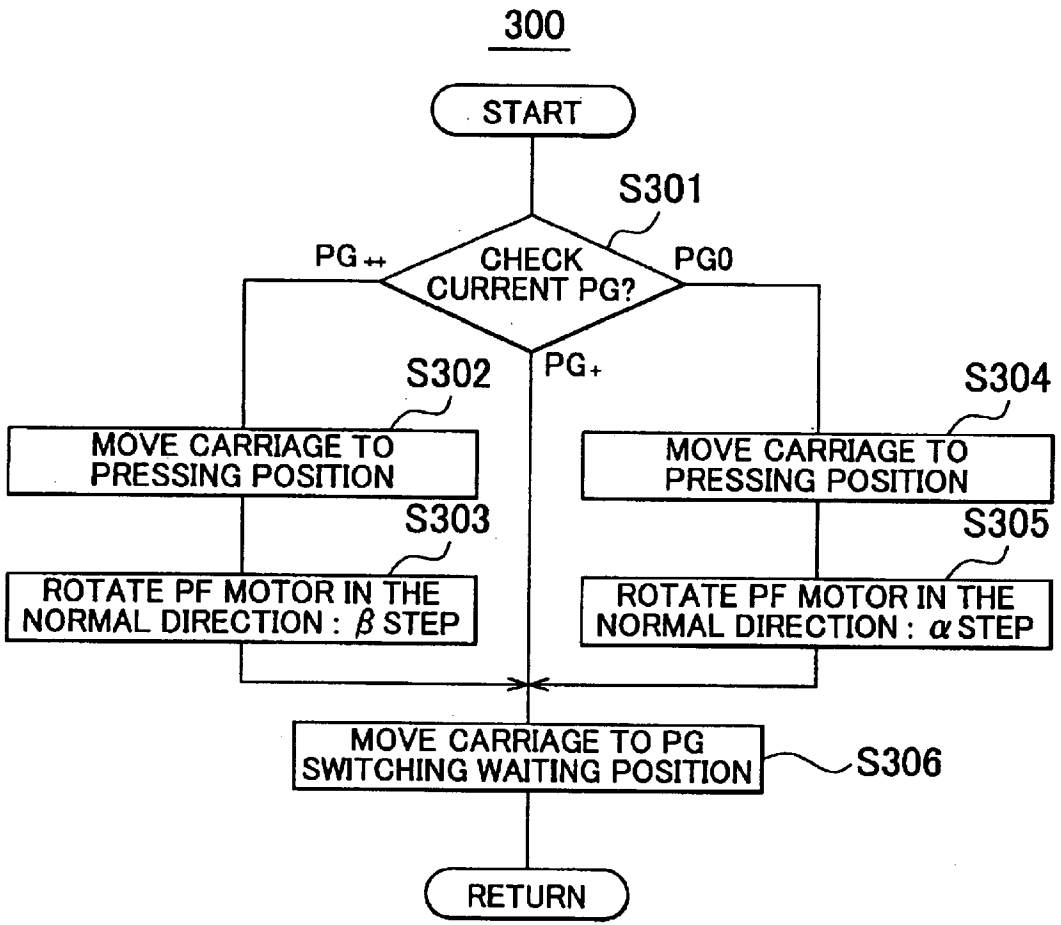
FIG. 14 shows a control flow when PG is switched.

Then, in the PG+ switching sequence shown in FIG. 14, current PG is checked first (Step S301). When current PG is "PG+", the operation goes back to the control routine at the higher level. When current PG is "PG++", the carriage 13 is moved to the pushing position (Step S302), the transfer motor 40 is rotated in the normal direction by β steps (Step S303), thereby bringing the carriage 13 back to the PG switching waiting position (Step S306). Thus, PG is changed from "PG++" shown in FIG. 11 to "PG+" shown in FIG. 10.

On the other hand, when current PG is "PG0", the carriage 13 is moved to the pushing position (Step S304). Then, the transfer motor 40 is rotated in the reverse direction by α steps (Step S305), thereby bringing the carriage 13 to the PG switching waiting position (Step S306). Thus, PG is changed from "PG0" shown in FIG. 9 to "PG+" shown in FIG. 10.

Figure 15:
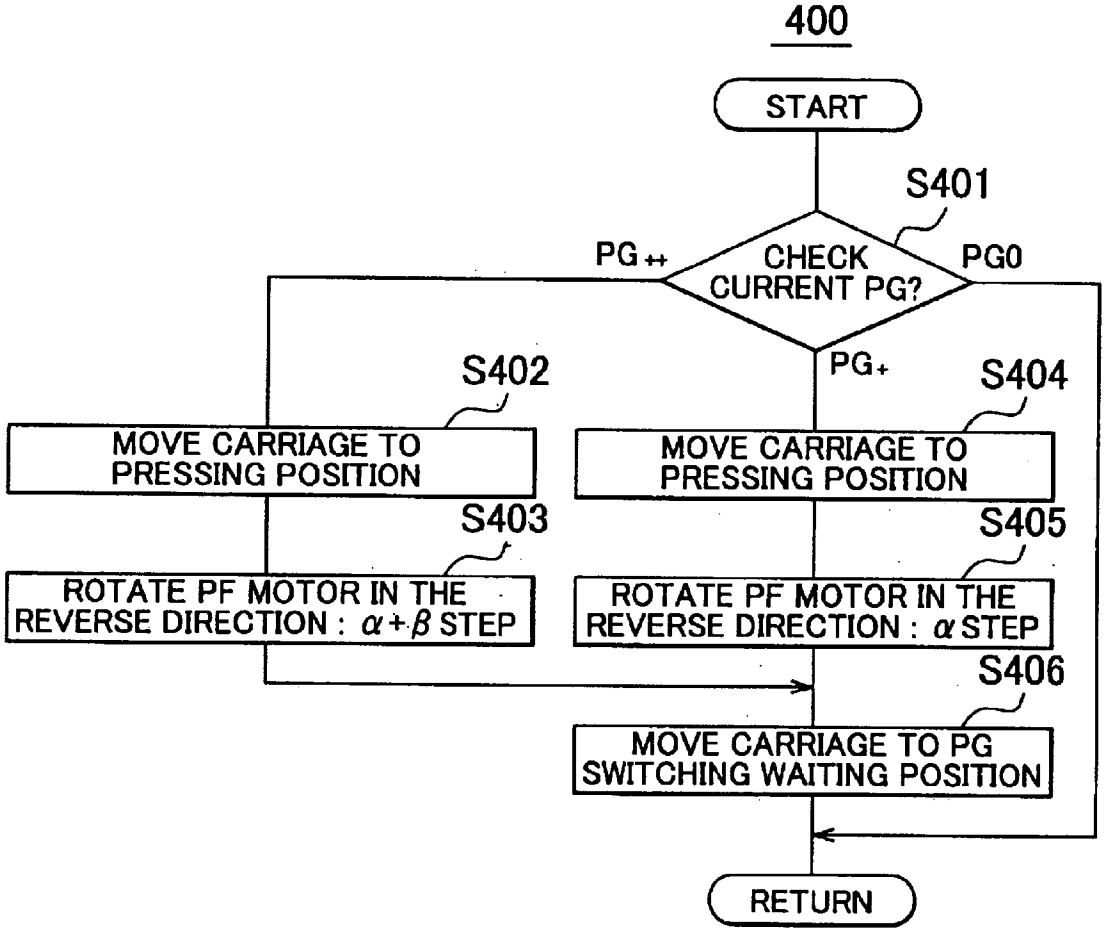
FIG. 15 shows a control flow when PG is switched.

In the PG0 switching sequence shown in FIG. 15, current PG is checked first (Step S401). When current PG is "PG", the operation goes back to the control routine at the higher level. When current PG is "PG++", the carriage 13 is moved to the pushing position (Step S402). Then, the transfer motor 40 is rotated by α+β steps (Step S403), thereby bringing the carriage 13 to the PG switching waiting position (Step S406). Thus, PG is changed from "PG++" shown in FIG. 11 to "PG0" shown in FIG. 9.

On the other hand, when current PG is "PG+", the carriage 13 is moved to the pushing position (Step S404). Then, the transfer motor 40 is moved in the normal direction by α steps (Step S405), thereby bringing the carriage 13 to the PG switching waiting position (Step S406). Thus, PG is changed from "PG+" shown in FIG. 10 to "PG0" shown in FIG. 9. In this manner, the gap adjusting device 50 can switch PG between "PG++", "PG+" and "PG0" in a stepwise manner.

Although the position corresponding to each of three PGs is detected by the number of steps of rotation of the transfer motor 40 (the number of steps detected by the rotary encoder) in the embodiment described above, it may be detected by providing sensors 71 and 72 shown in FIG. 4 and detecting the position of the slidable member 51 with those sensors 71 and 72.

In the gap adjusting device 50 described above, the weights of the main carriage guide shaft 11, sub-carriage guide shaft 12 and carriage 13 act on the bushing members 11 and 12, and therefore a force is applied to the bushing members 11 and 12, which causes the bushing members 11 and 12 to rotate in a counter clockwise direction, seen from the front (in FIGS. 9–11). This force is transmitted to the boss 65*c* via the intermediate gear 65 (which tends to rotate in a counterclockwise direction in FIGS. 9–11), thereby the boss 65*c* is displaced within the cam groove 53 while being pushed against the lower cam surface of the cam groove 53 and is in contact with that surface.

The direction in which the boss 65*c* is pushed is a direction that intersects with the sliding direction of the slidable member 51 (i.e., horizontal direction in FIGS. 9–11), and is substantially perpendicular to the sliding direction of the slidable member 51 in this embodiment. Therefore, the weights of the main carriage guide shaft 11, sub-carriage guide shaft 12 and carriage 13 do not act directly on the transfer motor 40 via the gear arrangement. Thus, PG can be adjusted with a small torque. Moreover, in the present embodiment, in order to prevent the boss 65*c* from bounding within the cam groove 53 (i.e., in order not to cause a slight change of PG at the position corresponding to each PG), a tension spring 66 is provided between the intermediate gear 65 and the left side frame 7 in such a manner that the boss 65*c* is always in contact with the lower cam surface of the cam groove 53. This also has little effect and therefore PG can be adjusted with a smaller torque.

The gap adjusting device 50 having the above-described structure can automatically switch PG between a plurality of positions (three positions in the present embodiment) by using the driving force of the transfer motor 40. The number of PG positions is not limited to three in the present embodiment, but it may be set to any other number other than three. In addition, the boss 65*c* is arranged to be in contact with the lower cam surface of the cam groove 53 while being pushed against that surface, in the present embodiment. Alternatively, the boss 65*c* may be in contact with the upper cam surface of the cam groove 53 while being pushed against that surface.

Moreover, in another embodiment of the present invention, the gap adjusting device 50 may include a "bending restraining means" for restraining bending of the intermediate gear 65 in a direction in which the boss 65*c* inserted into the cam groove 53 is removed from the cam groove 53 over the entire region within which the intermediate gear 65 can rotate, thereby preventing the boss 65*c* from falling from the cam groove 53*c*. Furthermore, instill another embodiment of the present invention, the gap adjusting device 50 may include a "busing-member-forcing means" for forcing the bushing members 67 and 68 in the direction in which they are forced to rotate by the weights of the carriage 13, main carriage guide shaft 11 and sub-carriage guide shaft 12. Next, the bending restraining means and the bushing-member-forcing means are described referring to FIGS. 16–20.

Figure 16:
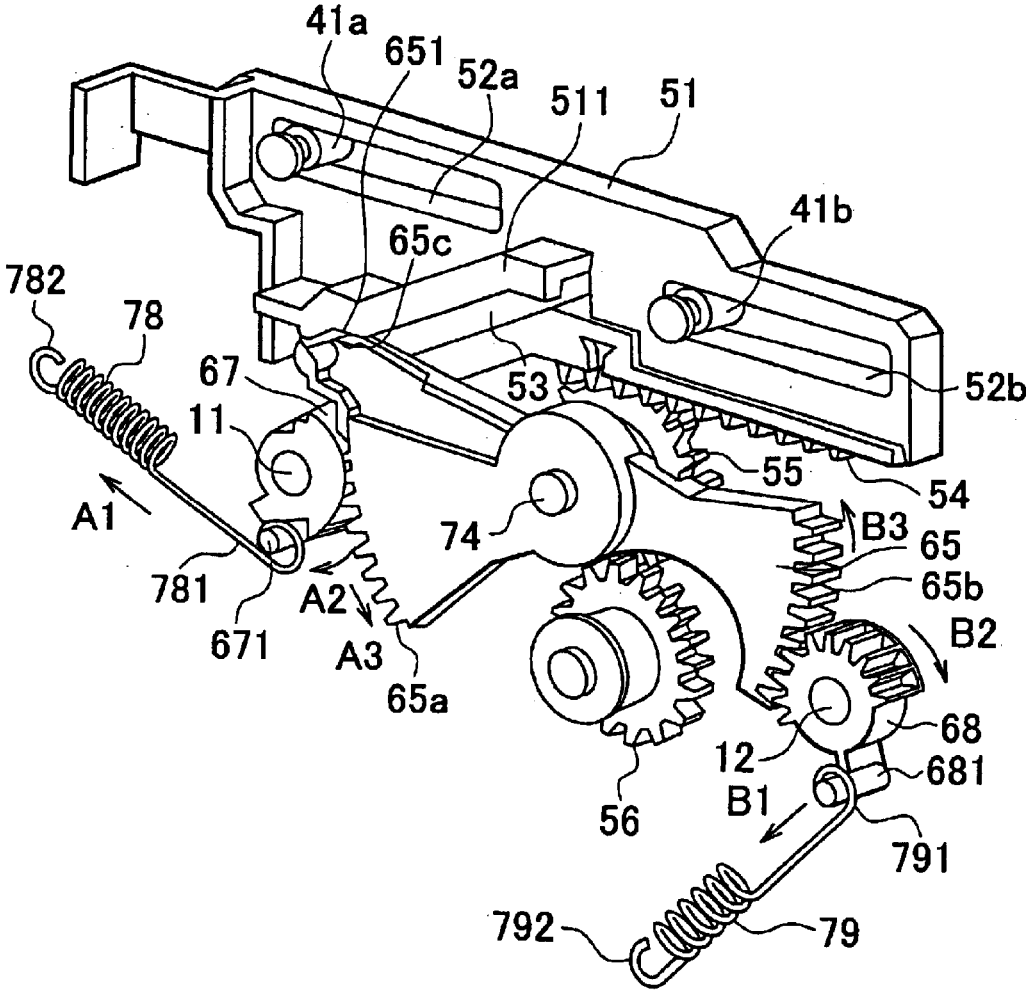
FIG. 16 is a perspective view of a main part of the gap adjusting device according to the present invention.
Figure 17:
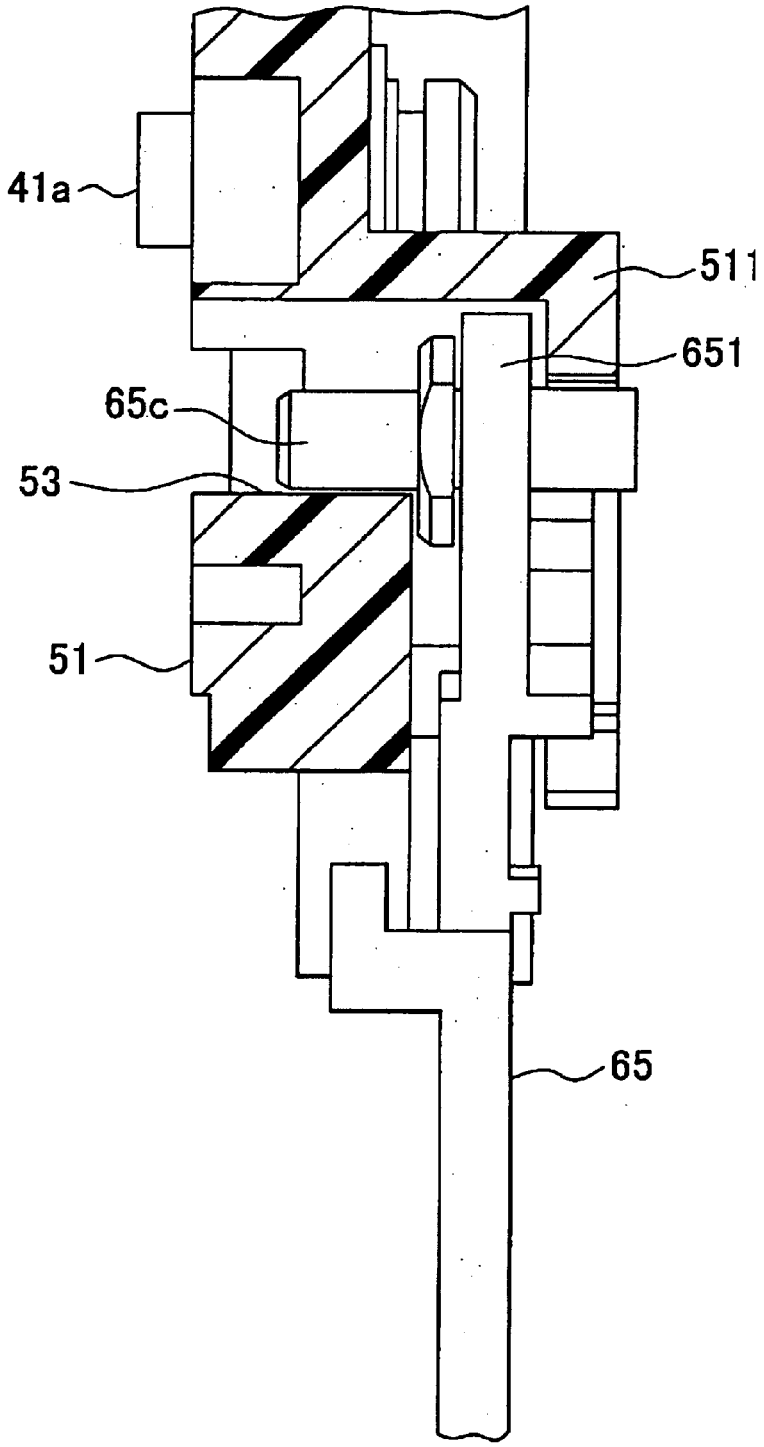
FIG. 17 is a side view of the main part of the gap adjusting device according to the present invention, showing the cross-section thereof.
Figure 18:
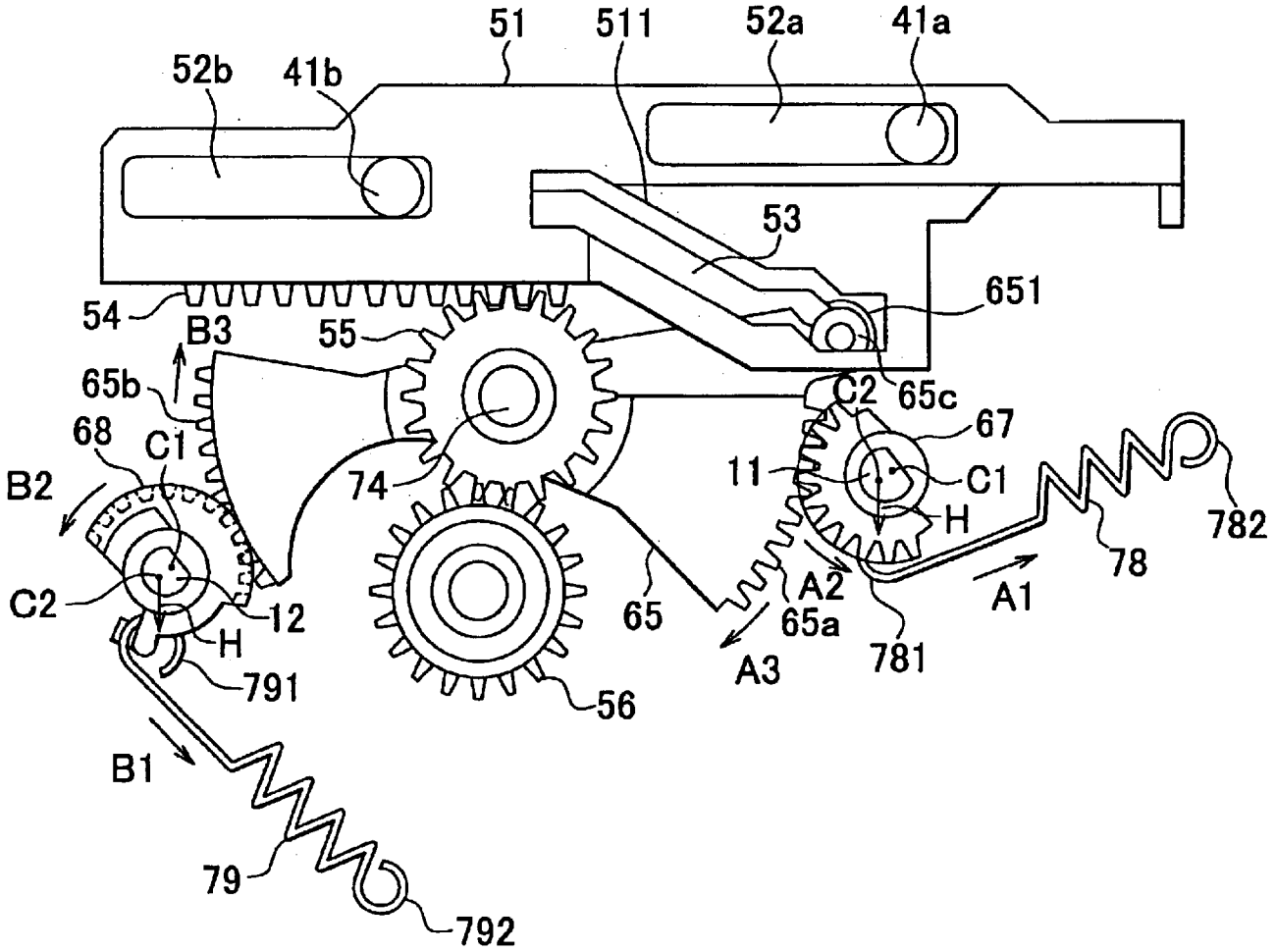
FIG. 18 is a front view of the main part of the gap adjusting device according to the present invention, seen from the back thereof.

FIG. 16 is a perspective view of a main part of the gap adjusting device 50 according to the present invention. FIG. 17 is a side view of the main part of the gap adjusting device 50 according to the present invention, showing a cross-section of the slidable member 51. FIG. 18 is a front view of the main part of the gap adjusting device 50 according to the present invention, seen from the back thereof.

First, the "bending restraining means" for restraining the bending of the intermediate gear 65 in the direction in which the boss 65*c* inserted in the cam groove 53 falls from the cam groove 53 over the entire region within which the intermediate gear 65 can rotate, so as to prevent the falling of the boss 65*c* from the cam groove 53 is described.

When the boss 65*c* of the intermediate gear 65 is displaced within the cam groove 53 by the sliding operation of the slidable member 51, thereby the intermediate gear 65 is rotated, the boss 65*c* is displaced in accordance with the shape of the cam groove 53 while being in contact with the inner surface of the cam groove 53 in a sliding manner, because the inner surface of the cam groove 53 pushes the boss 65*c*. Thus, a force that tends to bend the intermediate gear 65 toward the direction in which the boss 65*c* falls from the cam groove 53 is applied to the intermediate gear 65. If that force bends the intermediate gear 65 largely, the boss 65*c* may fall from the cam groove 53.

In order to prevent such falling of the boss 65*c*, a guide wall 511 is formed on the slidable member 51, as the "bending restraining means" for restraining the bending of the intermediate gear 65 in the direction in which the boss 65*c* falls from the cam groove 53 over the entire region within which the intermediate gear 65 can rotate. The guide wall 511 is formed along the cam groove 53, as shown in FIG. 16. A portion near the boss 65*c* of the intermediate gear 65 comes into contact with the guide wall 511, so that the bending of the intermediate gear 65 is restrained in the direction in which the boss 65*c* falls from the cam groove 53 in such a manner that the boss 65*c* can be displaced within the cam groove 53. Since the bending of the intermediate gear 65 is restrained in the direction in which the boss 65*c* falls from the cam groove 53, it is possible to prevent the large bending of the intermediate gear 65 and therefore the falling of the boss 65*c* from the cam groove 53, when the sliding operation of the slidable member 51 displaces the boss 65*c* of the intermediate gear 65 within the cam groove 53 so as to rotate the intermediate gear 65.

Next, the "bushing-member-forcing means" for forcing the bushing members 67 and 68 in the direction in which they are forced to rotate by the weights of the carriage 13, main carriage guide shaft 11 and sub-carriage guide shaft 12 is described.

The "bushing-member-forcing means" includes a coil spring 78 for forcing the bushing member 67 toward the direction in which the bushing member 67 is forced to rotate by the weights of the carriage 13 and main carriage guide shaft 11 (direction shown with arrow A2 in FIG. 16) and another coil spring 79 for forcing the bushing member 68 toward the direction in which the bushing member 68 is forced to rotate by the weights of the carriage 13 and sub-carriage guide shaft 12 (direction shown with arrow B2 in FIG. 16). As described above, the gap adjusting device 50 is arranged in such a manner that the center of rotation C1 of the bushing member 68 (bushing member 67) is located on the left side of the shaft center C2 of the sub-carriage guide shaft 12 (main carriage guide shaft 11). Thus, the weights of the sub-carriage guide shaft 12 (main carriage guide shaft 11) and carriage 13 act on the bushing member 68 (bushing member 67) and therefore a force for causing rotation in the direction shown with arrow B2 (arrow A2) is applied to the bushing member 68 (bushing member 67) (see FIG. 8). The coil spring 78 is attached to a convex portion 671 formed in the bushing member 67 at one end (portion 781) and is secured to the base side (not shown) of the printer 1 at the other end (portion 782). The spring force A1 of the coil spring 78 acts on the bushing member 67 in its rotation direction A2, that is, the rotation direction of the bushing member 67 that is forced by the weights H of the carriage 13 and main carriage guide shaft 11. The coil spring 79 is hooked to a convex portion 681 formed in the bushing member 68 at one end (portion 791) and is secured to the base side (not shown) of the printer 1 at the other end (portion 792). The spring force B1 of the coil spring 79 acts on the bushing member 68 in the rotation direction B2 of the bushing member 68, that is the direction in which the bushing member 68 is forced to rotate by the weights H of the carriage 13 and sub-carriage guide shaft 12. The spring force A1 of the coil spring 78 acts in the rotation direction of the intermediate gear 65 shown with arrow A3 via the bushing member 67, while the spring force of the coil spring 79 acts in the rotation direction of the intermediate gear 65 shown with arrow B3 via the bushing member 68.

Figure 19:
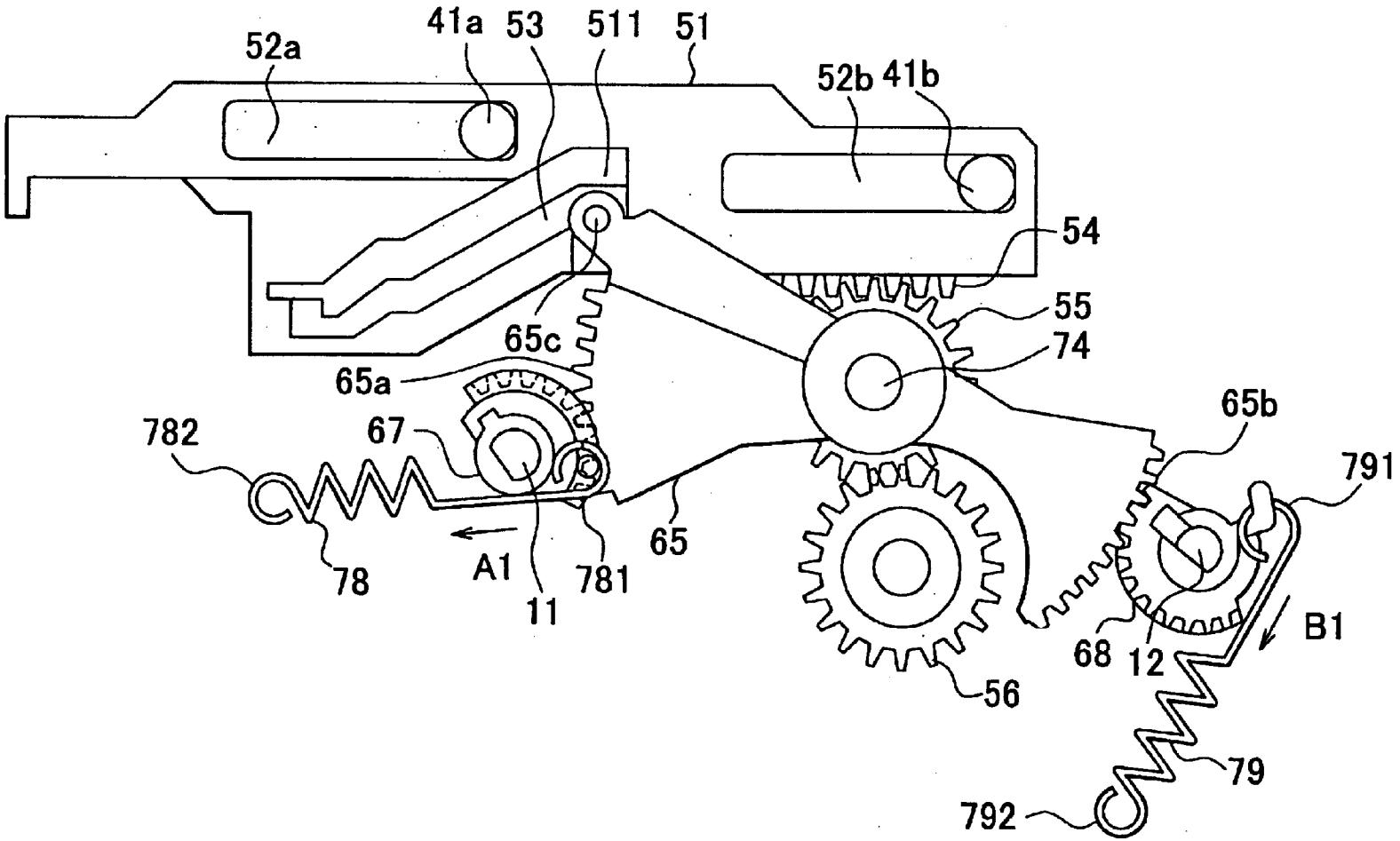
FIG. 19 is a front view of the main part of the gap adjusting device according to the present invention.
Figure 20:
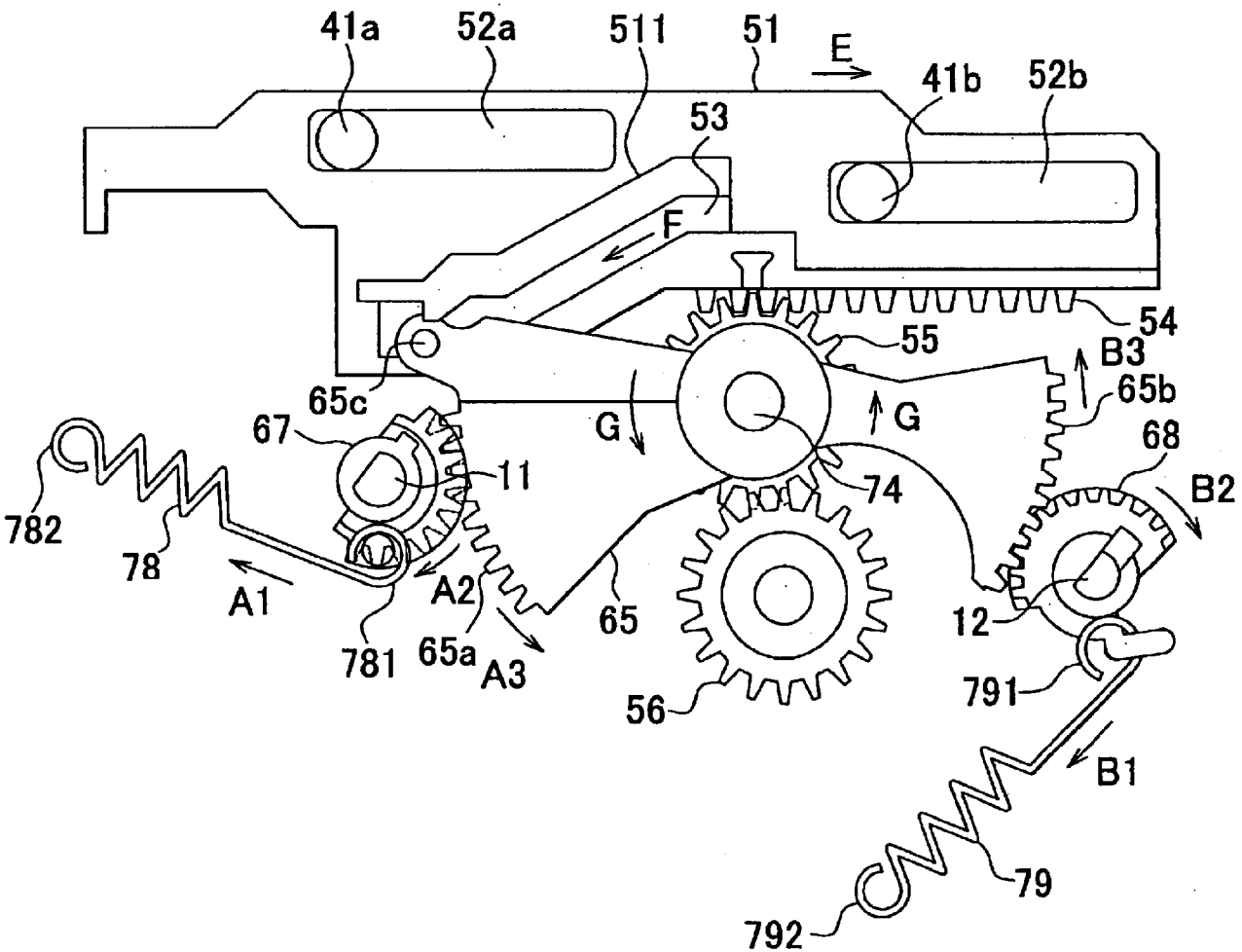
FIG. 20 is a front view of the main part of the gap adjusting device according to the present invention.
Figure 21:
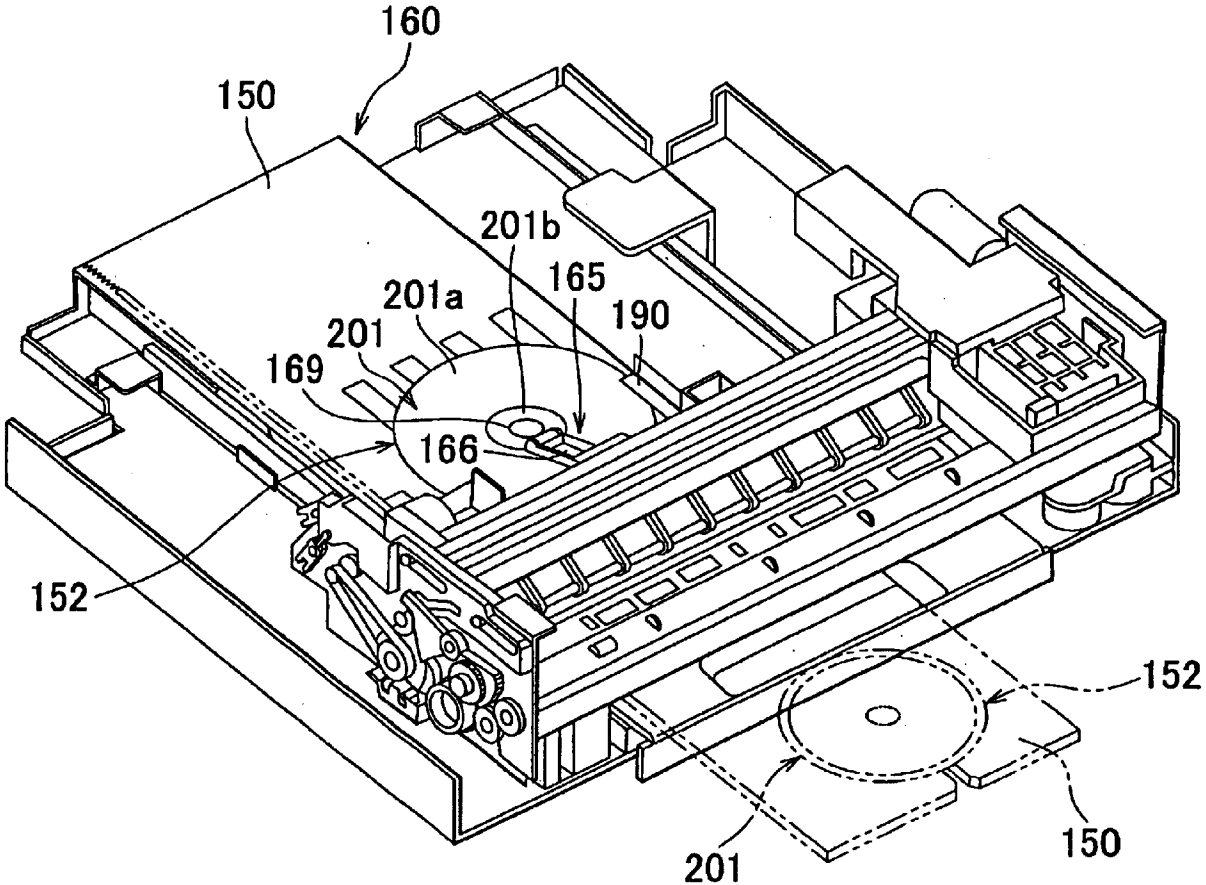
FIG. 21 is a perspective view of a left side of a recording apparatus according to the present invention, showing a state in which a housing is removed, seen from above.

FIGS. 19 and 20 are front views of a main part of the gap adjusting device 50 according to the present invention, showing a state where PG is "PG++" and a state where PG is "PG0", respectively.

When the slidable member 51 was caused to slide from the state of "PG++" (shown in FIG. 19) toward a direction shown with arrow E in FIG. 20, the boss 65*c* of the intermediate gear 65 is displaced in a direction shown with arrow G in FIG. 20 in accordance with the shape of the cam groove 53 and therefore the intermediate gear 65 is rotated in a direction shown with arrow G. The bushing member 67 is rotated in the direction A2 by the rotation A3 of a gear 65*a* of the intermediate gear 65, while the bushing member 68 is rotated in the direction B2 by the rotation B3 of a gear 65*b* of the intermediate gear 65. As a result, the main carriage guide shaft 11 and the sub-carriage guide shaft 12 are displaced, changing PG from "PG+" to "PG0. "As described above, the gap adjusting device 50 is arranged in such a manner that the weights of the carriage 13, main carriage guide shaft 11 and sub-carriage guide shaft 12 act on the boss 65*c* via the bushing members 67 and 68 and the intermediate gear 65 and therefore the boss 65*c* is displaced within the cam groove 53 while sliding on the cam surface on one side (side shown with H) in a direction intersecting with the sliding direction of the slidable member 51.

The spring force A1 of the coil spring 78 acts in the rotation direction of the intermediate gear 65 shown with arrow A3 via the bushing member 67, and the spring force B1 of the coil spring 79 acts in the rotation direction of the intermediate gear 65 shown with arrow B3 via the bushing member 68. Therefore, the boss 65*c* of the intermediate gear 65 is pushed by a force obtained by adding the weights of the carriage 13, main carriage guide shaft 11 and sub-carriage guide shaft 12 to the spring forces of the coil springs 78 and 79 toward the direction intersecting with the sliding direction of the slidable member 51, and slides on the cam surface on one side of the cam groove 53 while being in contact with that surface. Thus, the displaced position of the boss 65*c* of the intermediate gear 65, which is inserted in the cam groove 53 of the slidable member 51, can be made more stable, and therefore it is possible to set a gap between the recording head 14 and a recording medium (recording paper P or disk D) that is defined by the displaced position of the boss 65*c* with higher precision. Especially, the present invention is more effective in the ink-jet printer 1 that employs an off-carriage structure (in which the ink cartridge is not mounted on the carriage) and uses a light carriage 13.

To engagement portions of the bushing members 67 and 68 with the intermediate gear 65 is always applied the force obtained by adding the weights of the carriage 13, main carriage guide shaft 11 and sub-carriage guide shaft 12 to the spring forces of the coil springs 78 and 79 in the directions A2 and B2 of rotation of the bushing members 67 and 68 caused by the weights if the carriage 13, main carriage guide shaft 11 and sub-carriage guide shaft 12, respectively. Thus, backlash can be prevented between the bushing member 67 and the gear 65*a* of the intermediate gear 65 and between the bushing member 68 and the gear 65*b* of the intermediate gear 65.

Figure 22:
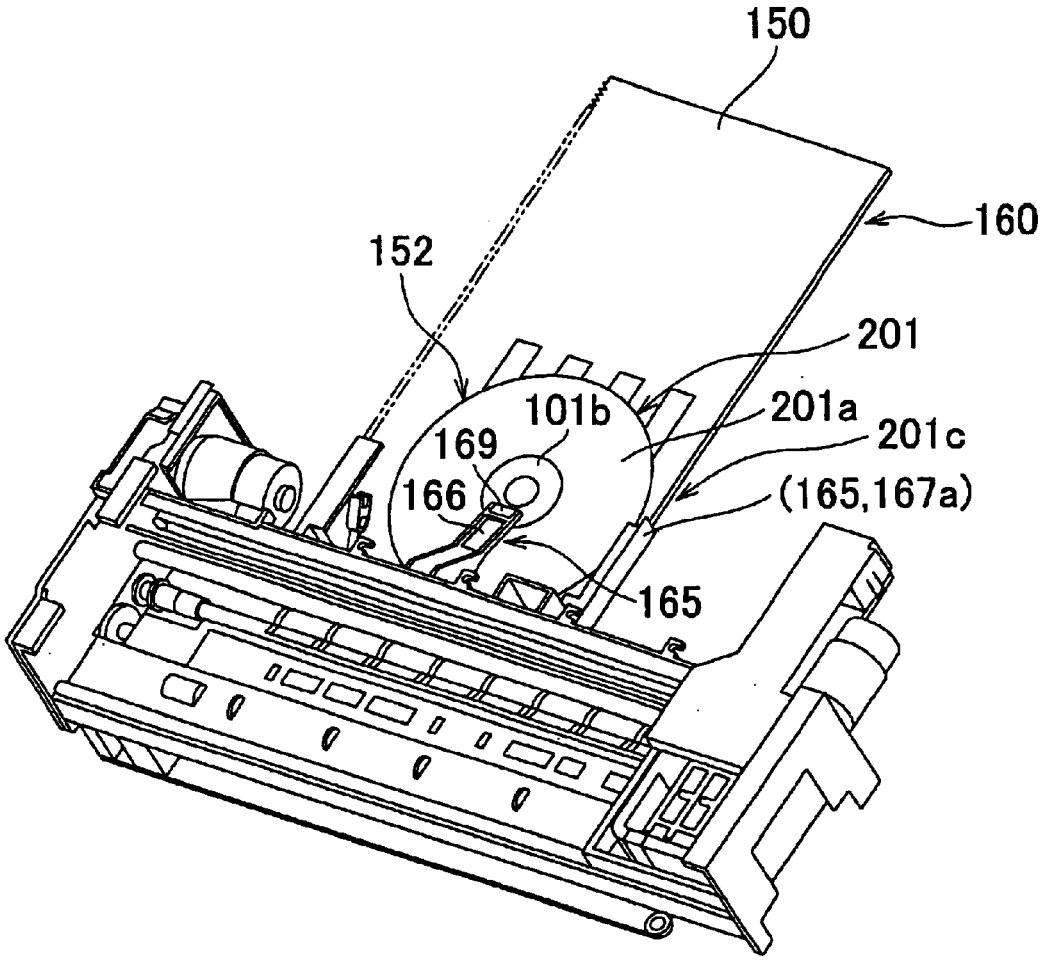
FIG. 22 is a perspective view of a right side of the recording apparatus according to the present invention, when a tray is located at a waiting position, seen from the front.

Next, a restraining means 165 according to the present invention is described. First, the restraining means 165 of the first embodiment is described, referring to FIGS. 22, 23 and 25 mainly.

A tray 150 has a set portion 152 in form of circular groove that is formed so as to prevent relative movement of an optical disk 201 in a horizontal direction.

As shown in FIGS. 21–24, a recording apparatus 101 includes the first restraining member 166 and the second restraining member 167*a* as the restraining means 165 of the first embodiment that can prevent vertical movement of the optical disk 201 at least when the tray 150 with the optical disk 201 placed therein is located at a waiting position 160, thereby preventing the optical disk 201 is disengaged from the set portion 152.

Figure 24:
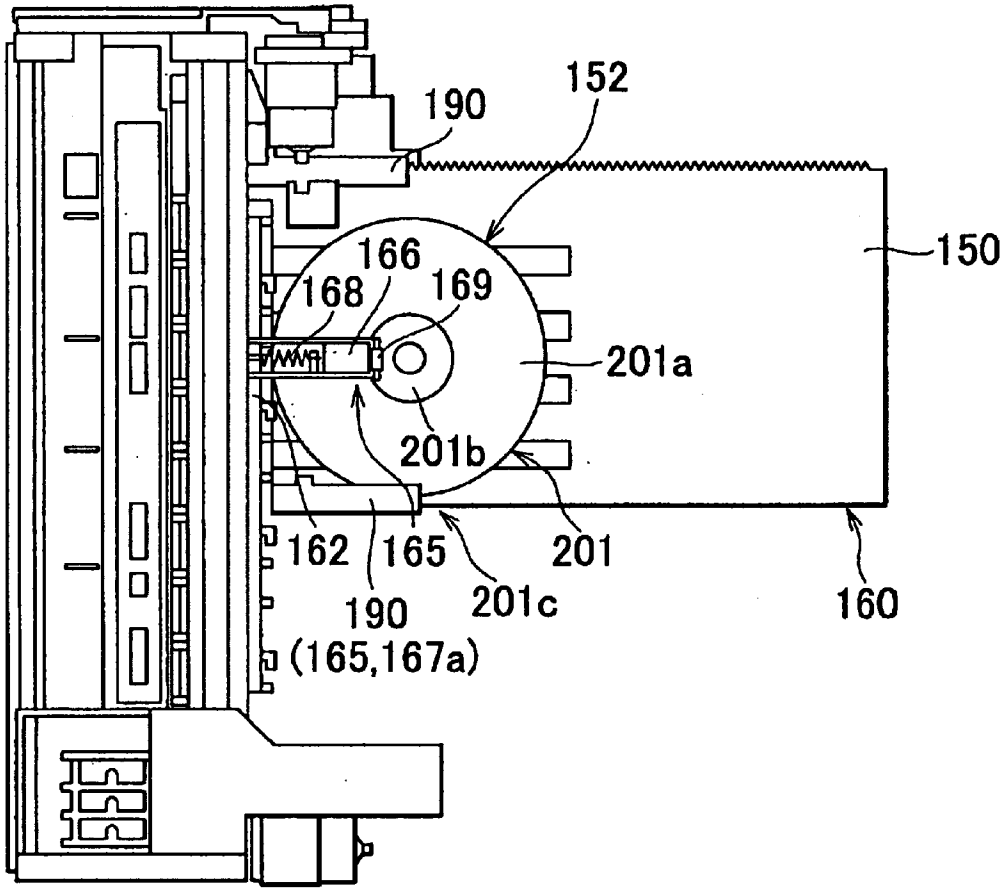
FIG. 24 is a plan view of the recording apparatus according to the present invention, when the tray is located at the waiting position.
Figure 25:
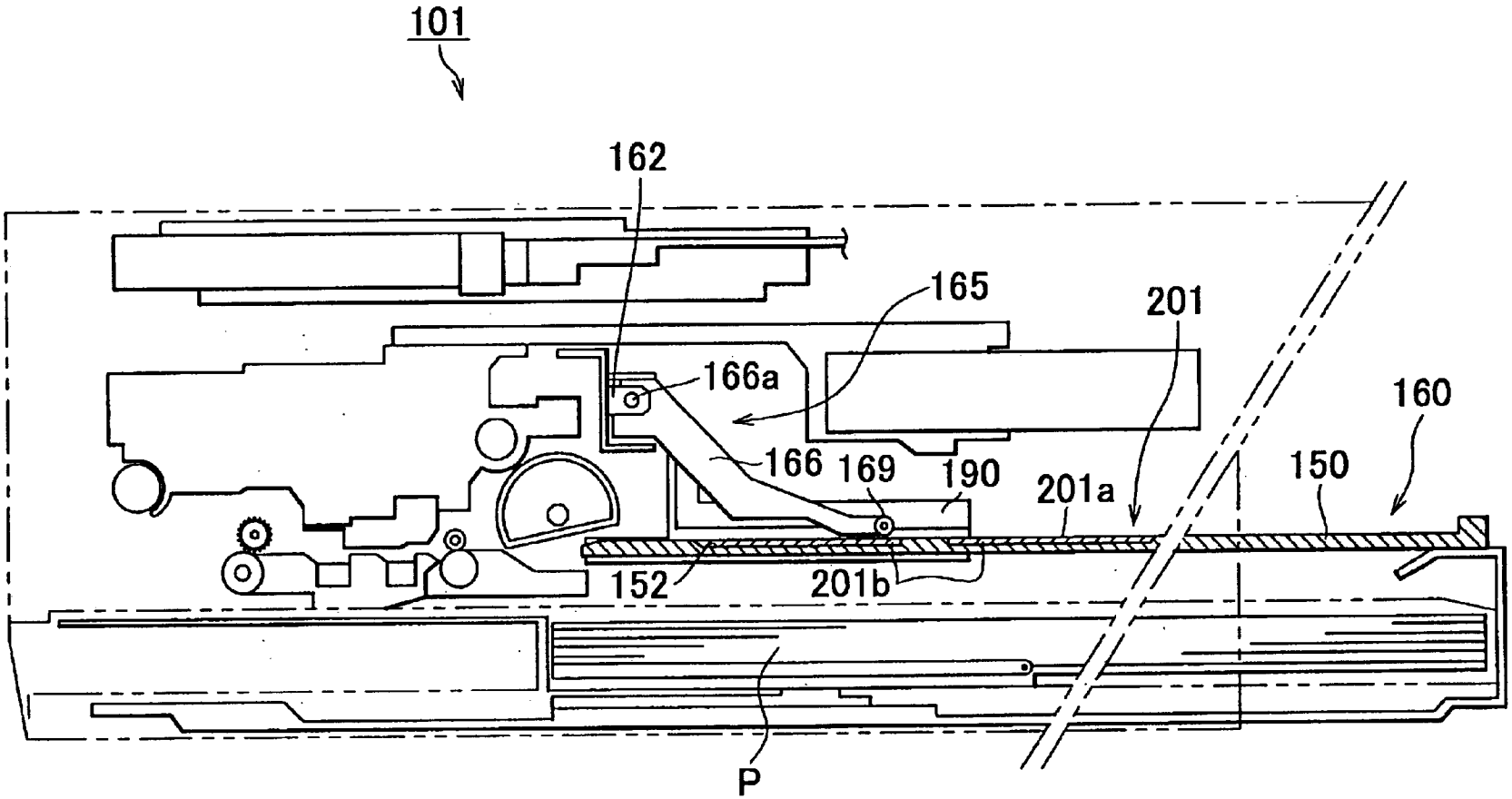
FIG. 25 is a cross-sectional view of the recording apparatus according to the present invention.

The first restraining member 166 is supported by a frame 162 at its center of rotation 166*a*, as shown in FIG. 25. The first restraining member 166 is arranged in such a manner that its top end can be brought into contact with a central portion 201*b* of the optical disk 201 set in the tray 150 located at the waiting position 160, as shown in FIGS. 21–25.

Therefore, at least when the tray 150 is located at the waiting position 160, the optical disk 201 set in the set portion 152 is restrained by the set portion 152 not to move in the horizontal direction, and is also restrained by the first restraining member 166 not to move in the vertical direction. Thus, the optical disk 201 cannot be disengaged from the set portion 152.

Figure 23:
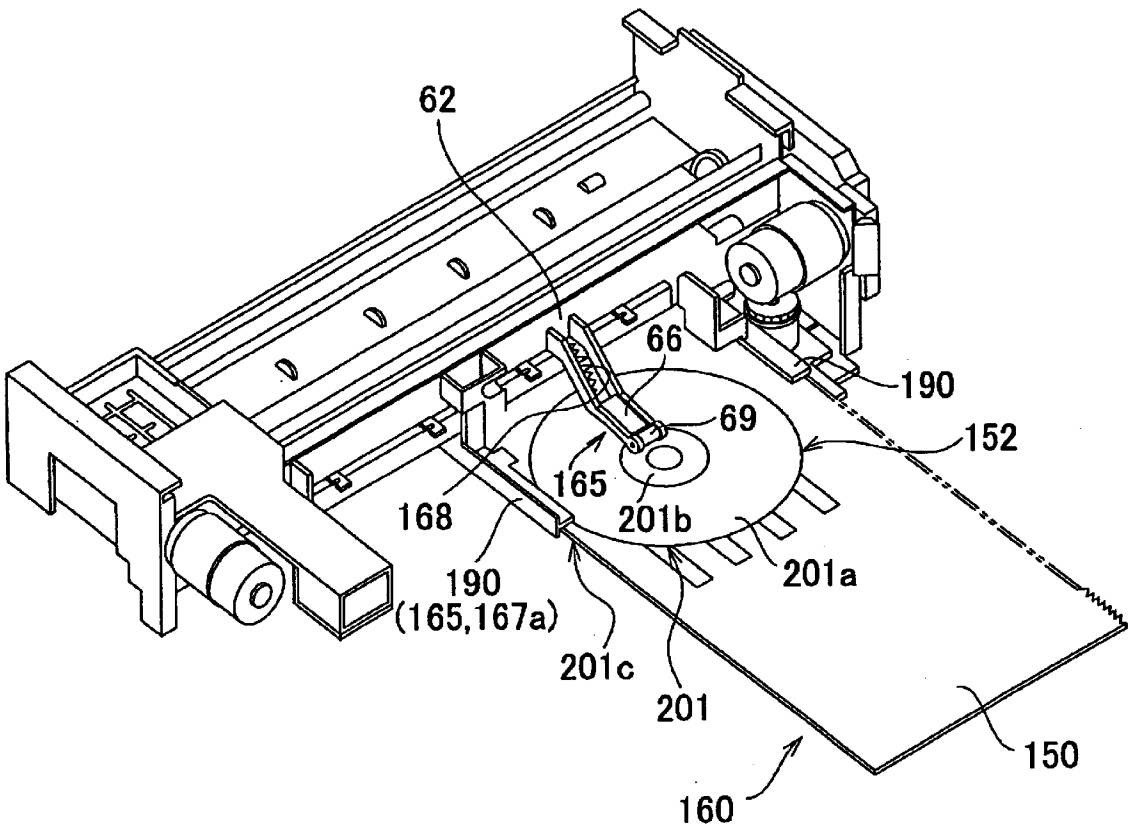
FIG. 23 is a perspective view of the right side of the recording apparatus according to the present invention, when the tray is located at the waiting position, seen from the back.

As shown in FIGS. 23 and 24, a coil spring 168 is provided between the frame 162 and the first restraining member 166, that forces the first restraining member 166 toward the tray 150. The coil spring 168 forces the first restraining member 166 in such a manner that the first restraining member 166 pushes the central portion 201*b* of the optical disk 201 set on the tray 150 at the waiting position 160 toward the tray 150.

At the top end of the first restraining member 166, a contact roller 169 that can be brought into contact with the optical disk 201 is supported at its shaft. The contact roller 160 is arranged to be rotated by the optical disk 201 when being in contact with the optical disk 201 transferred together with the tray 150.

Since the top end of the first restraining member 166 (i.e., the contact roller 169) can be in contact with the central portion 201*b* of the optical disk 201 placed in the set portion 152 of the tray 150 located at the waiting position 160, it is possible to hold the optical disk 201 to remain in the set portion 152, irrespective of the size of the optical disk 201.

More specifically, there are two types of compact disc that is a typical example of the optical disk, i.e., a compact disc having an outer diameter of 12 cm and one having an outer diameter of 8 cm. Both the two types of compact disc have a hole into which a convex portion 152 can fit, and can be set in the set portion 152. By using the restraining means that is formed to hold the central portion 201*b* of the optical disk 201 (the first restraining member 166, for example), it is possible to hold each and every compact disc not to be disengaged from the set portion 152.

Moreover, the first restraining member 166 is provided with the coil spring 168 in such a manner that the coil spring 168 presses the optical disk 201 set in the set portion 152 of the tray 150 located at the waiting position 160 against the tray 150. Thus, even if impact or vibration is applied to the recording apparatus 101, it is absorbed by the coil spring 168 and therefore disengagement or damage of the optical disk 201 can be prevented.

In addition, the contact roller 169 provided at the top end of the first restraining member 166 can be rotated with the movement of the optical disk 201 in a direction in which the optical disk 201 is transferred, i.e., in the sub-scanning direction, even while being in contact with the outer circumference of the optical disk 201 that is being transferred in the sub-scanning direction. Thus, the top end of the first restraining member 166 cannot be caught by the outer circumference of the optical disk 201, cannot enter a gap between the optical disk 201 and the tray 150 or cannot push the optical disk 201 to get away from the set portion 152. Therefore, it is possible to transfer the optical disk 201 smoothly.

Since the first restraining member 166 can come into contact with the central portion 201*b* of the optical disk 201, as described above, no other restraining means for holding the optical disk 201 is required. However, the recording apparatus according to this embodiment further includes the second restraining member 167*a* in order to hold the optical disk set in the set portion 152 of the tray 150 located at the waiting position 160 more surely. The second restraining member 167*a* serves as a member for restraining an outer edge 201*c* of the optical disk 201 that can come into contact with the outer edge 201*c*.

The second restraining member 167*a* also serves as guide member 190. By having the second restraining member 167*a* have functions of both the guide member 190 and the outer-edge restraining member for holding the outer edge of the optical disk, the number of components can be reduced and the structure can be simplified.

The restraining means 165 is not always in contact with the optical disk 201, as long as it can restrain the movement of the optical disk 201 (the vertical movement of the optical disk 201 in this embodiment) so as to prevent the disengagement of the optical disk 201 from the set portion 152.

The second restraining members 167*a* that also serves as the guide members 190 for sandwiching the tray 150 from above and beneath are preferably arranged to have a margin that prevents the second restraining member 167*a* from coming into contact with a recording face 201*a* of the optical disk 201 set on the tray 150.

More specifically, when the tray 150 is located at the waiting position 160, as shown in FIGS. 21–24, the second restraining member 167*a* covers a part of the recording face 201*a* of the optical disk 201. However, it is preferable that a small space be provided between the second restraining member 167*a* and the recording face 201*a*, which allows the optical disk 201 to move in the vertical direction and prevents the optical disk 201 from being removed from the set portion 152.

By providing such a space, the second restraining member 167*a* and the recording face 201*a* cannot come into contact with each other although the second restraining member 167*a* covers a part of the recording face 201*a*. Thus, various problems that may be caused in a case where the recording face 201*a* is in contact with the second restraining member 167*a* for a long time, such as a problem of sign of the contact can be prevented, thus preventing degradation of recording quality.

Moreover, by arranging the restraining member to be in contact with the central portion 201*b* of the optical disk 201 as an unrecorded portion where no recording is performed when the tray 150 with the optical disk 201 set therein is located at the waiting position 160, like the first restraining member 166, it is possible to prevent generation of the contact sign on the recording face 201*a*.

In this example, when the tray 150 is transferred to the waiting position 160, or is transferred forward from the waiting position 160, the top end of the first restraining member 166 (i.e., the contact roller 169) comes into contact with the recording face 201*a* of the optical disk 201 lying behind the central portion 201*b*. However, this contact occurs only while the tray 150 is moved, and does not continue for a long time. Therefore, this contact has little effect.

Figure 26:
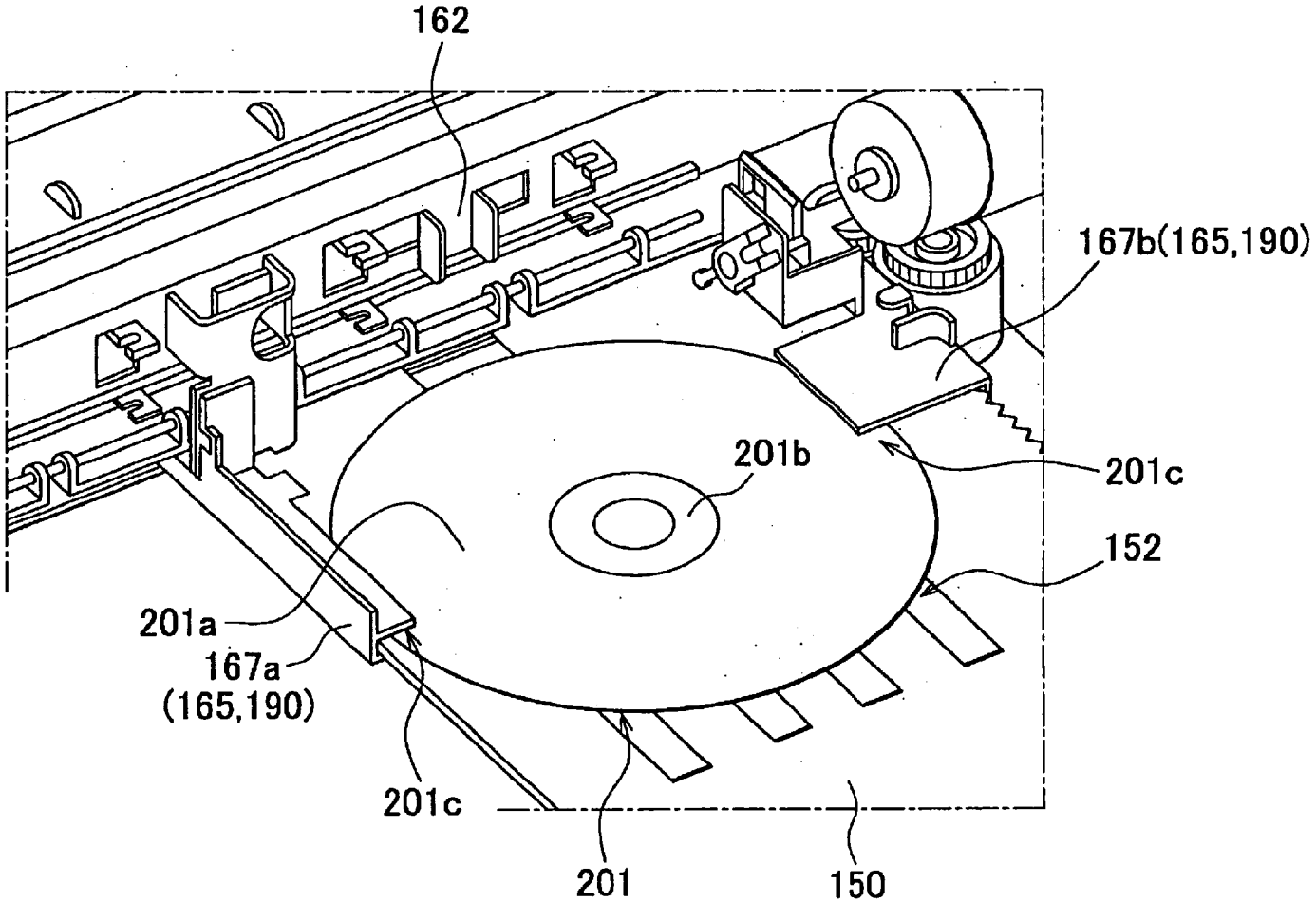
FIG. 26 is an enlarged view of a main part of the recording apparatus according to the present invention, showing the second exemplary restraining means.

In the above description, the first example of the restraining means 165 has been explained. Next, the second example of the restraining means 165 is described referring to FIG. 26 is an enlarged view of the restraining means 165 of the second example in the recording apparatus 101 from a direction similar to that of FIG. 23. The structure of the recording apparatus 101 is similar to that of the first example, and therefore the same components as those in the first example are labeled with the same reference numerals and the description thereof is omitted.

The restraining means 165 of the second example shown in FIG. 26 includes two outer-edge restraining members (second and third restraining members 167*a* and 167*b*) that can be brought into contact with the outer edge 201*c* of the optical disk 201 set in the set portion 152 of the tray 150. The second and third restraining members 167*a* and 167*b* can come into contact with two portions on the outer edge 201*c* that are located to sandwich the central portion 201*b* of the optical disk 201 therebetween, when the tray 150 is located at the waiting position 160. The second and third restraining members 167*a* and 167*b* can restrain the optical disk 201 in the vertical direction so as not to be removed from the set portion 152.

Referring to FIG. 26, the tray 150 is located at the waiting position 160. The tray 150 is supported at both ends in the width direction by the guide members 190 that are arranged to clip the tray 150 from above and beneath. The tray 150 can slide in the sub-scanning direction with respect to the guide members 190.

The guide members 190 are also arranged to serve as the second and third restraining member 167*a* and 167*b*, respectively.

Please note that the restraining means 165 of the second example is not always in contact with the optical disk 201, as long as it can restrain the movement (vertical movement in this example) of the optical disk 201 so as to prevent the disengagement of the optical disk 201 from the set portion 152.

The second and third restraining members 167*a* and 167*b* that also serve as the guide members 190 and clip the tray 150 from above and beneath, are preferably formed to have a space, that prevents the contact of the recording face 201*a* of the optical disk 201 with each of the second and third restraining members 167*a* and 167*b*, between the recording face 201*a* and each restraining member.

In other words, when the tray 150 is located at the waiting position 160, the second and third restraining members 167*a* and 167*b* partially cover the recording face 201*a* of the optical disk 201. However, it is preferable that a small space be provided between each of the restraining members and the recording face 201*a*, which allows the vertical movement of the optical disk 201 and prevents the disengagement of the optical disk 201 from the set portion 152.

By providing such a space, each restraining member cannot come into contact with the recording face 201*a* of the optical disk 201, although the restraining members 167*a* and 167*b* partially cover the recording face 201*a* of the optical disk 201. Therefore, various problems that may be caused in a case where either restraining member continues to be in contact with the recording face 201*a* for a long time can be prevented, thus preventing degradation of recording quality.

The present invention can be applied to a gap adjusting device for adjusting a gap between a recording head and a recording medium, and a recording apparatus including that gap adjusting device. The present invention can be also applied to a liquid ejection apparatus.

Although the present invention has been described by way of exemplary embodiments, it should be understood that those skilled in the art might make many changes and substitutions without departing from the spirit and the scope of the present invention which is defined only by the appended claims.

What is claimed is:

1. A gap adjusting device for use in a recording apparatus including a carriage having a recording head for performing recording onto a recording medium and a carriage guide shaft for guiding said carriage in a main scanning direction, for adjusting a gap between said recording head and the recording medium by adjusting a level of said carriage guide shaft, said gap adjusting device comprising:

a bushing member attached to an end of said carriage guide shaft and a side frame that is provided to stand perpendicularly to a direction of a shaft line of said carriage guide shaft to be rotatable, said bushing member being operable to support said carriage guide shaft in such a manner that a center of rotation is not coincident with a shaft center of said carriage guide shaft; and a bushing-member rotating means operable to engage with said rotating member and rotate said bushing member, said busing-member rotating means being driven by a power of a motor, wherein said bushing-member rotating means includes:

a slidable member provided to be slidable along a surface of said side frame by the power of said motor;

a slidable-member locking means operable to restrain a sliding operation of said slidable member; and a bushing-member rotating member having a bushing-member engagement portion that is to engage with said bushing member and a boss inserted into a cam groove formed in said slidable member in a movable manner and being provided to be rotatable, said bush-member rotating member being rotated by displacement of said boss within said cam groove in accordance with the sliding operation of said slidable member, to rotate said bushing member, a bushing-member forcing means is provided in such a manner that said boss is displaced within said cam groove while being in contact with a cam surface on one side of said cam groove and is pressed against said cam surface in a direction intersecting with a sliding direction of said slidable member, by weights of said carriage and said carriage guide shaft that act on said boss via said bushing member and said bushing-member rotating member, said bushing-member forcing means forcing said bushing member in a direction in which said busing member is forced to rotate by the weights of said carriage and said carriage guide shaft.

2. A gap adjusting device as claimed in claim 1, wherein said bushing member and said bushing-member engagement portion of said bushing-member rotating member engage with each other to form together an arrangement of transmitting rotation.

3. A gap adjusting device as claimed in claim 1, wherein said cam groove has a changing portion where said gap is changed and an unchanging portion where said gap is prevented from being changed and is formed in a stairway-like shape, to allow stepwise adjustment of said gap between a plurality of gap positions.

4. A gap adjusting device as claimed in claim 3, wherein said cam groove has three unchanged portions to allow said gap to be switched among three levels.

5. A gap adjusting device as claimed in claim 1, wherein said bushing-member rotating means includes a gear arrangement provided on the side frame, said gear arrangement including a rack formed on said slidable member, a pinion engaging said rack and a gear that is rotated by the power of said motor and causing the sliding operation of said slidable member by rotation of said pinion, one gear of said gear arrangement is provided to be slidable in its rotation axis and is arranged in such a manner that said one gear is able to disconnect transmission of the power of said motor by disengaging from said gear arrangement, and a sliding operation of said one gear is achieved by a forcing means for forcing said one gear in a direction in which said one gear engages another gear, and said carriage that pushes an engagement pin provided on said one gear in a direction in which said one gear disengages from said gear arrangement, said engagement pin protruding through an arc-shaped hole formed in said side frame toward a main scanning region of said carriage.

6. A gap adjusting device as claimed in claim 5, wherein said motor is a transfer motor for driving and rotating a transfer roller for transferring the recording medium.

7. A gap adjusting device as claimed in claim 5, wherein said slidable-member locking means includes an engagement protrusion formed on a disc surface of said one gear, and a plurality of fitting holes, formed in said side frame, into which said engagement protrusion is able to fit, said fitting holes being located at positions where said engagement protrusion is to be located at a plurality of gap positions.

8. A gap adjusting device as claimed in claim 1, wherein said carriage is arranged to be guided by two carriage guide shafts arranged in a sub-scanning direction with a predetermined space, and said bushing-member rotating member is arranged between said two carriage guide shafts to rotate said bushing member attached to said shaft end of each of said two carriage guide shaft simultaneously.

9. A recording apparatus comprising:

a carriage including a recording head for performing recording onto a recording medium;

a carriage guide shaft operable to guide said carriage in a main scanning direction; and a gap adjusting device operable to adjust a level of said carriage guide shaft to adjust a gap between said recording head and the recording medium, wherein said gap adjusting device is a device as claimed in any one of the preceding claims.

10. A liquid ejection apparatus comprising:

a carriage having a liquid ejection head for performing liquid ejection onto a medium;

a carriage guide shaft operable to guide said carriage in a main scanning direction; and a gap adjusting device operable to adjust a level of said carriage guide shaft to adjust a gap between said liquid ejection head and said medium, wherein said gap adjusting device includes:

a bushing member attached to an end of said carriage guide shaft and to a side frame that is provided to stand perpendicularly to a direction of a shaft line of said carriage guide shaft to be rotatable, said bushing member supporting said carriage guide shaft in such a manner that a center of rotation of said bushing member is not coincident with a shaft center of said carriage guide shaft; and a bushing-member rotating means operable to engage with said bushing member to rotate said bushing member, said bushing-member rotating means being driven by a power of a motor, and wherein said bushing-member rotating means includes:

a slidable member provided to be slidable along a surface of said side frame by the power of said motor;

a slidable-member locking means operable to restrain a sliding operation of said slidable member; and a bushing-member rotating member, provided to be rotatable and to have a bushing-member engagement portion for engaging with said bushing member and a boss to be inserted into a cam groove formed in said slidable member, said bushing-member rotating member being rotated by displacement of said boss within said cam groove in accordance with the sliding operation of said slidable member, to rotate said bushing member, and wherein a forcing means is provided in such a manner that said boss is displaced within said cam groove while being in contact with a cam surface on one side of said cam groove is pushed toward a direction intersecting with a sliding direction of said slidable member, by weights of said carriage and said carriage guide shaft that act on said boss via said bushing member and said bushing-member rotating member, and forces said bushing member in a direction in which said bushing member is forced to rotate by said carriage and said carriage guide shaft.

11. A gap adjusting device for use in a recording apparatus including a carriage having a recording head for performing recording onto a recording medium and a carriage guide shaft for guiding said carriage in a main scanning direction, for adjusting a level of said carriage guide shaft to adjust a gap between said recording head and the recording medium, said gap adjusting device comprising:

a bushing member, attached to an end of said carriage guide shaft and to a side frame that is provided to stand perpendicularly to a direction of a shaft line of said carriage guide shaft in a rotatable manner, said bushing member supporting said carriage guide shaft in such a manner that a center of rotation of said bushing member is not coincident with a shaft center of said carriage guide shaft; and a bushing-member rotating means operable to engage with said bushing member and to rotate said bushing member, said bushing-member rotating means being driven by a power of a motor, wherein said bushing-member rotating means includes:

a slidable member provided to be slidable along a surface of said side frame by the power of said motor;

a slidable member locking means operable to restrain a sliding operation of said slidable member; and a bushing-member rotating member, provided to be rotatable and to have a bushing-member engagement portion for engaging with said bushing member and a boss to be inserted into a cam groove formed in said slidable member, said bushing-member rotating member being rotated by displacement of said boss within said cam groove in accordance with the sliding operation of said slidable member, to rotate said bushing member, and wherein said boss is arranged to be displaced within said cam groove while being in contact with a cam surface on one side of said cam groove and is pushed in a direction intersecting with a sliding direction of said slidable member, by weights of said carriage and said carriage guide shaft that act on said boss via said busing member and said bushing-member rotating member.

12. A gap adjusting device as claimed in claim 11, wherein said slidable member includes a bending restraining means operable to restrain bending of said bushing-member rotating member in a direction in which said boss inserted in said cam groove falls from said cam groove to prevent falling of said boss from said cam groove over an entire region within which said bushing-member rotating member is able to rotate.

13. A gap adjusting device as claimed in claim 12, wherein said bending restraining means includes a guide wall formed along said cam groove, said guide groove being in contact with a portion near said boss of said bushing-member rotating member to restrain the bending of said bushing-member rotating member in the direction in which said boss falls from said cam groove in such a manner that said boss is able to be displaced within said cam groove.

14. A gap adjusting device as claimed in claim 11, wherein said cam groove is formed in a stairway-like shape that has a changing portion where said gap is changed and an unchanged portion where said gap is prevented from being changed to adjust said gap between a plurality of gap positions.

15. A gap adjusting device as claimed in claim 14, wherein said cam groove has three unchanged portions to allow switching of said gap among three levels.

16. A gap adjusting device as claimed in claim 11, wherein said bushing-member rotating means includes a gear arrangement provided on said side frame, said gear arrangement including a rack formed on said slidable member, a pinion engaging with said rack and a transmission gear operable to rotate by the power of said motor, said gear arrangement being arranged to slide said slidable member by rotation of said pinion, one gear of said gear arrangement is arranged be slidable in its rotation axis to be able to disconnect transmission of the power of said motor by disengaging from said gear arrangement, and a sliding operation of said one gear is achieved by a forcing means operable to force said one gear toward a direction in which said one gear engages with another gear, and said carriage that pushes an engagement pin formed on said one gear toward a direction in which said one gear disengages from said gear arrangement, said engagement pin protruding through an arc-shaped hole formed in said side frame toward a main scanning region of said carriage.

17. A gap adjusting device as claimed in claim 16, wherein said motor is a transfer motor for driving and rotating a transfer roller for transferring the recording medium.

18. A gap adjusting device as claimed in claim 16, wherein said slidable-member locking means includes an engagement protrusion formed on a disc face of said one gear, and a plurality of fitting holes formed in said side frame, into which said engagement protrusion is able to fit, said fitting holes being arranged at positions at which said engagement protrusion is to be located at a plurality of gap positions.

19. A gap adjusting device as claimed in claim 11, wherein said carriage is guided by two carriage guide shafts arranged in a sub-scanning direction with a predetermined space therebetween, and said bushing-member rotating member is arranged between said two carriage guide shafts and rotates said bushing member attached to said end of each of said two carriage guide shafts simultaneously.

20. A recording apparatus comprising:

a carriage having a recording head for performing recording onto a recording medium;

a carriage guide shaft operable to guide said carriage in a main scanning direction; and a gap adjusting device operable to adjust a level of said carriage guide shaft to adjust a gap between said recording head and the recording medium, wherein said gap adjusting device is claimed in claim 11.

21. A liquid ejection apparatus comprising:

a carriage having a liquid ejection head for performing liquid ejection onto a medium;

a carriage guide shaft operable to guide said carriage in a main scanning direction; and a gap adjusting device operable to adjust a level of said carriage guide shaft to adjust a gap between said liquid ejection head and the medium, wherein said gap adjusting device includes:

a bushing member, attached to an end of said carriage guide shaft and to a side frame that is provided to stand perpendicularly to a direction of a shaft line of said carriage guide shaft in a rotatable manner, said bushing member supporting said carriage guide shaft in such a manner that a center of rotation of said bushing member is not coincident with a shaft center of said carriage guide shaft; and a bushing-member rotating means operable to engage with said bushing member and to rotate said bushing member, said bushing-member rotating means being driven by a power of a motor, wherein said bushing-member rotating means includes:

a slidable member provided to be slidable along a surface of said side frame by the power of said motor;

a slidable-member locking means operable to restrain a sliding operation of said slidable member; and a bushing-member rotating member provided to be rotatable and to have a bushing-member engagement portion for engaging with said bushing member and a boss to be inserted into a cam groove formed in said slidable member, said bushing-member rotating member being rotated by displacement of said boss within said cam groove in accordance with the sliding operation of said slidable member, to rotate said bushing member, and wherein said boss is arranged to be displaced within said cam groove while being in contact with a cam surface on one side of said cam groove and is pressed in a direction intersecting with a sliding direction of said slidable member, by weights of said carriage and said carriage guide shaft that act on said boss via said bushing member and said bushing-member rotating member.

* * * * *

UNITED STATES PATENT AND TRADEMARK OFFICE

CERTIFICATE OF CORRECTION

PATENT NO. : 6,921,217 B2
DATED : July 26, 2005
INVENTOR(S) : Keishiro Tsuji

It is certified that error appears in the above-identified patent and that said Letters Patent is hereby corrected as shown below:

Column 22,
Line 33, delete "said rotating member" and insert -- said bushing member --.

Signed and Sealed this

Thirtieth Day of May, 2006

JON W. DUDAS
*Director of the United States Patent and Trademark Office*